US008985724B2

(12) United States Patent
Takagi et al.

(10) Patent No.: US 8,985,724 B2
(45) Date of Patent: Mar. 24, 2015

(54) IMAGE FORMING APPARATUS, IMAGE CORRECTION METHOD, AND NON-TRANSITORY COMPUTER READABLE RECORDING MEDIUM STORING IMAGE CORRECTION PROGRAM

(75) Inventors: Yasunobu Takagi, Kanagawa (JP); Toshihito Kamei, Tokyo (JP); Takashi Kimura, Kanagawa (JP); Yoshimi Nemoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 70 days.

(21) Appl. No.: 13/606,887

(22) Filed: Sep. 7, 2012

(65) Prior Publication Data

US 2013/0063512 A1 Mar. 14, 2013

(30) Foreign Application Priority Data

Sep. 8, 2011 (JP) ..... 2011-195776
Apr. 13, 2012 (JP) ..... 2012-091693

(51) Int. Cl.
*B41J 29/393* (2006.01)
*B41J 29/38* (2006.01)
*B41J 2/21* (2006.01)

(52) U.S. Cl.
CPC ..... *B41J 29/38* (2013.01); *B41J 2/2132* (2013.01)
USPC ..... 347/14; 347/19

(58) Field of Classification Search
CPC ..... B41J 2/04505; B41J 2/04508; B41J 2/04558; B41J 2/0457; B41J 2/0459; B41J 2/04591; B41J 2/05; B41J 2/2054; B41J 2/2128
USPC ..... 347/14, 15, 19
See application file for complete search history.

(56) References Cited

U.S. PATENT DOCUMENTS 6,053,596 A * 4/2000 Nakano et al. ..... 347/15
6,089,766 A 7/2000 Yamada et al.
6,517,175 B2 2/2003 Kanaya et al.
2008/0309703 A1* 12/2008 Yamazaki ..... 347/19
2009/0018881 A1 1/2009 Ito et al.

(Continued)

FOREIGN PATENT DOCUMENTS

JP 05-124221 5/1993
JP 11-099643 4/1999

(Continued)

OTHER PUBLICATIONS

U.S. Appl. No. 13/409,504, filed Mar. 1, 2012, Takagi et al.

*Primary Examiner* — Geoffrey Mruk
*Assistant Examiner* — Scott A Richmond
(74) *Attorney, Agent, or Firm* — Harness, Dickey & Pierce, P.L.C.

(57) ABSTRACT

Disclosed is an image forming apparatus that includes a recording head for forming an image by discharging single color ink from plural nozzle sequences. The image forming apparatus includes a profile generating unit configured to generate a profile including discharging characteristics of the corresponding nozzle sequences and information indicating a positional relationship among the plural nozzle sequences, based on individual images of a predetermined pattern that have been formed by the corresponding nozzle sequences and images that have been formed by the nozzle sequences; and a driving condition determination unit configured to determine drive conditions of the corresponding nozzle sequences by referring to the profile.

12 Claims, 34 Drawing Sheets

191 192

| CORRECTION CONDITION | | LINE 11 | | LINE 12 | | SOLID IMAGE DENSITY VALUE | TOTAL SCORE |
|---|---|---|---|---|---|---|---|
| LINE 11 | LINE 12 | LINE WIDTH | SATELLITE | LINE WIDTH | SATELLITE | DENSITY | |
| α | α | 8 | 10 | 6 | 8 | 6 | 38 |
| α | β | 8 | 10 | 7 | 7 | 7 | 39 |
| α | γ | 8 | 10 | 8 | 5 | 8 | 39 |
| β | α | 10 | 10 | 6 | 8 | 6 | 40 |
| β | β | 10 | 10 | 7 | 7 | 7 | 41 |
| β | γ | 10 | 10 | 8 | 5 | 9 | 42 |
| γ | α | 6 | 9 | 6 | 8 | 8 | 37 |
| γ | β | 6 | 9 | 7 | 7 | 9 | 38 |
| γ | γ | 6 | 9 | 8 | 5 | 10 | 38 |

(56) References Cited

U.S. PATENT DOCUMENTS

| | | | | |
|---|---|---|---|---|
| 2009/0179934 | A1 | 7/2009 | Takagi et al. | |
| 2010/0182366 | A1 | 7/2010 | Takagi et al. | |
| 2010/0182367 | A1 | 7/2010 | Takagi et al. | |
| 2010/0201726 | A1 * | 8/2010 | Kondo et al. | 347/10 |
| 2010/0207982 | A1 | 8/2010 | Satoh et al. | |
| 2012/0147078 | A1 | 6/2012 | Takagi et al. | |
| 2012/0147082 | A1 | 6/2012 | Takagi et al. | |

FOREIGN PATENT DOCUMENTS

| | | |
|---|---|---|
| JP | 2001-105635 | 4/2001 |
| JP | 2005-138494 | 6/2005 |
| JP | 3835045 | 10/2006 |
| JP | 2007-030458 | 2/2007 |
| JP | 2008-162067 | 7/2008 |

* cited by examiner

FIG.15

151

| | LINE WIDTH (μm) | SCORE |
|---|---|---|
| UPPER LIMIT OF STANDARD | GREATER THAN OR EQUAL TO 115 | 0 |
| | 112.5～115 | 1 |
| | 110～112.5 | 2 |
| | 107.5～110 | 3 |
| | 105～107.5 | 4 |
| | 112.5～105 | 5 |
| | 110～112.5 | 6 |
| | 107.5～110 | 7 |
| | 105～107.5 | 8 |
| | 102.5～105 | 9 |
| TARGET VALUE (100 μm) | 97.5～102.5 | 10 |
| | 95～97.5 | 9 |
| | 92.5～95 | 8 |
| | 90～92.5 | 7 |
| | 87.5～90 | 6 |
| | 85～87.5 | 5 |
| | 82.5～85 | 4 |
| | 80～82.5 | 3 |
| | 77.5～80 | 2 |
| | 75～77.5 | 1 |
| LOWER LIMIT OF STANDARD | LESS THAN OR EQUAL TO 75 | 0 |

FIG.16

161

| | DIFFERENCE BETWEEN LINE WIDTHS (μm) | SCORE |
|---|---|---|
| UPPER LIMIT OF STANDARD | GREATER THAN OR EQUAL TO 25 | 0 |
| | 22.5～25.0 | 1 |
| | 20.0～22.5 | 2 |
| | 17.5～20.0 | 3 |
| | 15.0～17.5 | 4 |
| | 12.5～15.0 | 5 |
| | 10.0～12.5 | 6 |
| | 7.5～10.0 | 7 |
| | 5.0～7.5 | 8 |
| | 2.5～5.0 | 9 |
| TARGET VALUE | LESS THAN OR EQUAL TO 2.5 | 10 |

FIG.17

171

| | SATELLITE (INK COATING AMOUNT%) | SCORE |
|---|---|---|
| UPPER LIMIT OF STANDARD | GREATER THAN OR EQUAL TO 10% | 0 |
| | 9～10% | 1 |
| | 8～9% | 2 |
| | 7～8% | 3 |
| | 6～7% | 4 |
| | 5～6% | 5 |
| | 4～5% | 6 |
| | 3～4% | 7 |
| | 2～3% | 8 |
| | 1～2% | 9 |
| TARGET VALUE | LESS THAN OR EQUAL TO 1% | 10 |

FIG.18

181

| | DENSITY | SCORE |
|---|---|---|
| | GREATER THAN OR EQUAL TO 1.29 | 10 |
| | 1.28～1.29 | 9 |
| | 1.27～1.28 | 8 |
| | 1.26～1.27 | 7 |
| | 1.25～1.26 | 6 |
| | 1.24～1.25 | 5 |
| | 1.23～1.24 | 4 |
| | 1.22～1.23 | 3 |
| | 1.21～1.22 | 2 |
| | 1.20～1.21 | 1 |
| LOWER LIMIT OF STANDARD | LESS THAN OR EQUAL TO 1.20 | 0 |

FIG.19

| CORRECTION CONDITION | | LINE 11 | | LINE 12 | | SOLID IMAGE DENSITY VALUE (191) | TOTAL SCORE (192) |
|---|---|---|---|---|---|---|---|
| LINE 11 | LINE 12 | LINE WIDTH | SATELLITE | LINE WIDTH | SATELLITE | DENSITY | |
| α | α | 8 | 10 | 6 | 8 | 6 | 38 |
| α | β | 8 | 10 | 7 | 7 | 7 | 39 |
| α | γ | 8 | 10 | 8 | 5 | 8 | 39 |
| β | α | 10 | 10 | 6 | 8 | 6 | 40 |
| β | β | 10 | 10 | 7 | 7 | 7 | 41 |
| β | γ | 10 | 10 | 8 | 5 | 9 | 42 |
| γ | α | 6 | 9 | 6 | 8 | 8 | 37 |
| γ | β | 6 | 9 | 7 | 7 | 9 | 38 |
| γ | γ | 6 | 9 | 8 | 5 | 10 | 38 |

FIG.20

| CORRECTION CONDITION | | LINE 11 | | LINE 12 | | SOLID IMAGE DENSITY VALUE (193) | TOTAL SCORE (194) |
|---|---|---|---|---|---|---|---|
| LINE 11 | LINE 12 | LINE WIDTH | SATELLITE | LINE WIDTH | SATELLITE | DENSITY | |
| α | α | 8 | 10 | 6 | 8 | 6 | 38 |
| α | β | 8 | 10 | 7 | 7 | 7 | 39 |
| α | γ | 8 | 10 | 8 | 5 | 8 | – |
| β | α | 10 | 10 | 6 | 8 | 6 | 41 |
| β | β | 10 | 10 | 7 | 7 | 7 | 42 |
| β | γ | 10 | 10 | 8 | 5 | 9 | – |
| γ | α | 6 | 9 | 6 | 8 | 8 | 37 |
| γ | β | 6 | 9 | 7 | 7 | 9 | 17 |
| γ | γ | 6 | 9 | 8 | 5 | 10 | – |

FIG.34

171A

| | SATELLITE (SATELLITE ESTIMATED VALUES) | SCORE |
|---|---|---|
| UPPER LIMIT OF STANDARD | 91～100 | 0 |
| | 81～90 | 1 |
| | 71～80 | 2 |
| | 61～70 | 3 |
| | 51～60 | 4 |
| | 41～50 | 5 |
| | 31～40 | 6 |
| | 21～30 | 7 |
| | 11～20 | 8 |
| | 1～10 | 9 |
| TARGET VALUE | 0 | 10 |

IMAGE FORMING APPARATUS, IMAGE CORRECTION METHOD, AND NON-TRANSITORY COMPUTER READABLE RECORDING MEDIUM STORING IMAGE CORRECTION PROGRAM

BACKGROUND OF THE INVENTION

1. Field of the Invention

Embodiments of the present invention relate to an image forming apparatus including a recording head that forms an image by discharging the same color of ink from plural nozzle sequences, an image correction method, and an image correction program.

2. Description of the Related Art

A configuration has conventionally been known where a recording head is mounted on an inkjet printer. Here, the recording head includes plural nozzles from which ink is discharged. In such an inkjet printer, pressure is applied to ink liquid chambers disposed in the recording head by using a piezoelectric element or a heater element, and the ink is discharged toward a recording medium. Thereby, an image is formed.

Examples of the conventional inkjet printers include a serial inkjet printer that forms an image by moving the head in a direction that is perpendicular to a sheet conveyance direction and a line inkjet printer that forms an image by fixedly arranging plural heads in line and by conveying a sheet of paper in a direction that is perpendicular to a longitudinal direction of the heads. For both the serial inkjet printer and the line inkjet printer, the image quality depends on the adhering property of ink on a sheet of paper. Therefore, techniques for adjusting the discharging property and the discharging timing of the recording head have been developed. For example, Patent Document 1 (Japanese Patent Laid-Open Application No. 2001-105635) discloses a technique for aligning print positions among plural print heads. Patent Document 2 (Japanese Patent Laid-Open Application No. 2008-162067) discloses a technique for preventing positional shifts of positions where dots are recorded. Patent Document 3 (Japanese Patent Laid-Open Application No. H5-124221) discloses techniques for adjusting registration and correcting density unevenness.

Incidentally, conventional recording heads include recording heads having plural nozzle sequences. Examples of the recording head having the plural nozzle sequences include recording heads in which the nozzle sequences are arranged while the nozzle sequences are shifted from each other and recording heads in which the nozzle sequences are arranged in parallel. When the nozzle sequences are arranged while the nozzle sequences are shifted from each other, the resolution in the longitudinal direction of the heads is improved. When the nozzle sequences are arranged in parallel, the resolution in the discharging direction is improved. Further, when the plural nozzle sequences are arranged in parallel, even if there is a nozzle that fails to discharge the ink, the failure on the image can be made unnoticeable or the image can be interpolated by another nozzle.

In the conventional recording head including the plural nozzle sequences, an ink discharging characteristic of a nozzle sequence may be different from that of another nozzle sequence. The difference of the discharging characteristic may be attributable to many reasons, such as manufacturing variations of the components included in the nozzle sequences and the circuits for driving the nozzle sequences, and the differences among the flow characteristics of the ink flowing through the corresponding nozzle sequences due to the positional differences of the corresponding nozzle sequences. When there are differences among the discharging characteristics of the corresponding nozzle sequences, the adhering conditions of the ink droplets to the recording medium may vary. Therefore, such differences may cause an unintentional failure on the image.

The discharging characteristic of the nozzle sequences may be corrected by correcting signals that are applied to the nozzle sequences. However, for the case of the recording head having the plural nozzle sequences, since the discharging characteristic of a nozzle sequence may be different from that of another nozzle sequence, a sufficient correction effect may not be obtained only by correcting a signal that is commonly applied to the nozzle sequences.

Further, when the recording head includes the plural nozzle sequences, an image is formed by combining all the nozzle sequences. Therefore, an optimum adjustment value for adjusting the discharging characteristic for a case where the ink is individually discharged from the corresponding nozzle sequences may be different from that of another case where the ink is discharged from all the nozzle sequences.

Hereinafter, there will be explained density adjustment processes of a recording head including nozzle sequences 11 and 12 during an image formation process, while referring to FIGS. 1 and 2. FIGS. 1A and 1B are first diagrams illustrating the density adjustment processes of a conventional recording head including two nozzle sequences during the image formation process. FIG. 2 is a second diagram illustrating the density adjustment process of the conventional recording head including two nozzle sequences during the image formation process.

In FIG. 1A, a density value of an image formed by the nozzle sequence 11 and another density value of another image that is separately formed by the nozzle sequence 12 are within the corresponding target ranges. Additionally, in FIG. 1A, a density value of an image formed by combining the nozzle sequences 11 and 12 is within a target range. In FIG. 1B, additional separated lines are observed in an image formed by the nozzle sequence 12. Here, the density values of images individually formed by the nozzle sequence 11 and the nozzle sequence 12 are in the corresponding target ranges. However, when an image is formed by combining the nozzle sequences 11 and 12, gaps are observed in the formed image, and the density value of the image does not reach the target range.

In such a case, the density value of the image may be increased by increasing driving voltages of the nozzle sequences 11 and 12. However, when the driving voltages of the nozzle sequences 11 and 12 are uniformly increased, the stability of the discharging characteristic of the nozzle sequence 12, whose ink discharging characteristic has been unstable, may become worse.

Further, in FIG. 2, the density value of the image formed by combining the nozzle sequences 11 and 12 is within the target range. However, when the nozzle sequences 11 and 12 are individually observed, it can be found that an ink discharging amount of the nozzle sequence 11 is large and that an ink discharging amount of the nozzle sequence 12 is small. Therefore, when an image of evenly spaced lines are formed by the recording head, an image failure may occur, since a width of each of the lines formed by the nozzle sequence 11 and a width of each of the lines formed by the nozzle sequence 12 are different.

Further, when a driving condition of the nozzle sequences are changed, it is possible that positions on the sheet of paper where the ink discharged from the nozzle sequences are adhered are varied. Further, even if the discharging characteristics of the plural nozzle sequences are the same, a failure may occur in a formed image when the plural nozzle sequences are combined. FIGS. 3A and 3B are diagrams illustrating cases where corresponding images are formed by combining plural nozzle sequences having the same discharging characteristics.

In FIGS. 3A and 3B, the ink discharging characteristics of the nozzle sequences 11 and 12 are the same. In FIG. 3A, relative adhering positions of the ink discharged from the nozzle sequences 11 and 12 are in accordance with the target positions. On the other hand, in FIG. 3B, adhering positions of the ink discharged from the nozzle sequence 11 are relatively shifted from the corresponding adhering positions of the ink discharged from the nozzle sequence 12. As described, even if the plural nozzle sequences having the same ink discharging characteristics are combined, a manner of covering a recording medium with the ink may be different from a usual manner, and a failure may occur in the formed image.

The embodiments of the present invention have been developed in view of the above circumstances. An objective of the embodiments of the present invention is to provide an image forming device, an image correction method, and an image correction program, with which plural nozzle sequences can be optimally adjusted.

SUMMARY OF THE INVENTION

In order to achieve the above-described objective, the following configurations have been adopted.

According to an aspect of the present invention, there is provided an image forming apparatus including a recording head configured to form an image by discharging ink having the same color from plural nozzle sequences. The image forming apparatus includes a profile generating unit configured to generate a profile including discharging characteristics of the corresponding nozzle sequences and information indicating a positional relationship among the plural nozzle sequences, based on individual images of a predetermined pattern that have been formed by the corresponding nozzle sequences and images that have been formed by the nozzle sequences; and a driving condition determination unit configured to determine drive conditions of the corresponding nozzle sequences by referring to the profile.

According to another aspect of the present invention, there is provided an image correction method executed by an image forming apparatus including a recording head configured to form an image by discharging single color ink from plural nozzle sequences, a profile generating step, by the image forming apparatus, of generating a profile including discharging characteristics of the corresponding nozzle sequences and information indicating a positional relationship among the plural nozzle sequences, based on individual images of a predetermined pattern that have been formed by the corresponding nozzle sequences and images that have been formed by the nozzle sequences; a storing step, by the image forming apparatus, of storing the profile in a storing unit; and a driving condition determination step, by the image forming apparatus, of determining drive conditions of the corresponding nozzle sequences by referring to the profile stored in the storing unit.

According to another aspect of the present invention, there is provided a non-transitory computer readable recording medium storing an image correction program for causing an image forming apparatus, the image forming apparatus including a recording head configured to form an image by discharging single color ink from plural nozzle sequences, to execute a profile generating step of generating a profile including discharging characteristics of the corresponding nozzle sequences and information indicating a positional relationship among the plural nozzle sequences, based on individual images of a predetermined pattern that have been formed by the corresponding nozzle sequences and images that have been formed by the nozzle sequences; a storing step of storing the profile in a storing unit; and a driving condition determination step of determining drive conditions of the corresponding nozzle sequences by referring to the profile stored in the storing unit.

According to the embodiments of the present invention, adjustment of the plural nozzle sequences can be optimally performed.

Other objects, features and advantages of the present invention will become more apparent from the following detailed description when read in conjunction with the accompanying drawings.

BRIEF DESCRIPTION OF THE DRAWINGS

FIG. 15 is a first diagram illustrating a score table;

FIG. 16 is a second diagram illustrating the score table;

FIG. 17 is a third diagram illustrating the score table;

FIG. 18 is a fourth diagram illustrating the score table;

FIG. 19 is a first diagram showing an example of a drive condition table;

FIG. 20 is a second diagram showing another example of the drive condition table;

FIG. 34 is a fifth diagram illustrating the score table.

DETAILED DESCRIPTION OF THE PREFERRED EMBODIMENTS

In the following embodiments, for a recording head that forms an image by discharging single color ink from plural nozzle sequences, profiles of the corresponding nozzle sequences are formed. A driving signal supplied to the recording head is corrected based on discharging characteristics of the corresponding nozzle sequences and a positional relationship among the plural nozzle sequences that are obtained from the corresponding profiles. In this manner, images are corrected.

<First Embodiment>

Figure 1A:
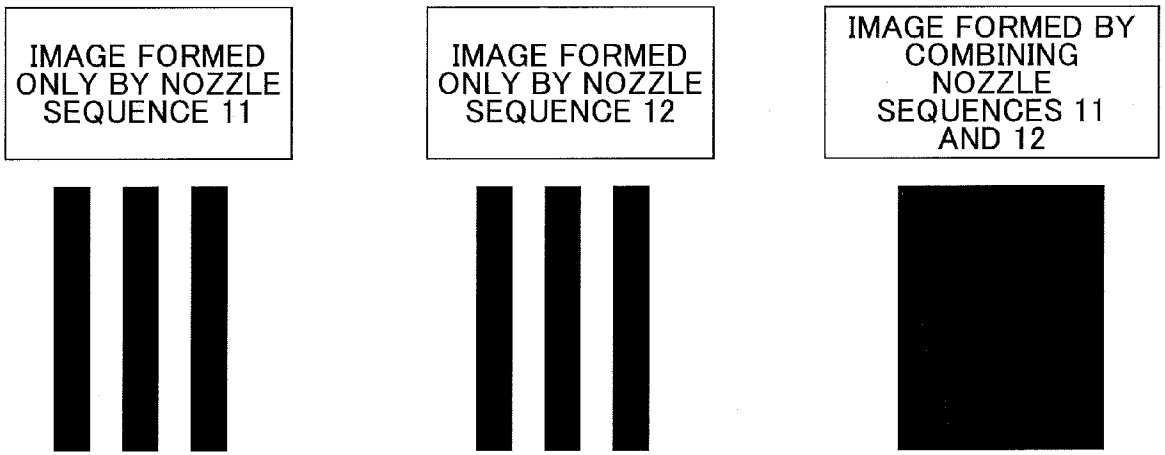
FIGS. 1A and 1B are first diagrams for illustrating density adjustment processes of a conventional recording head including two nozzle sequences during image formation processes.
Figure 1B:
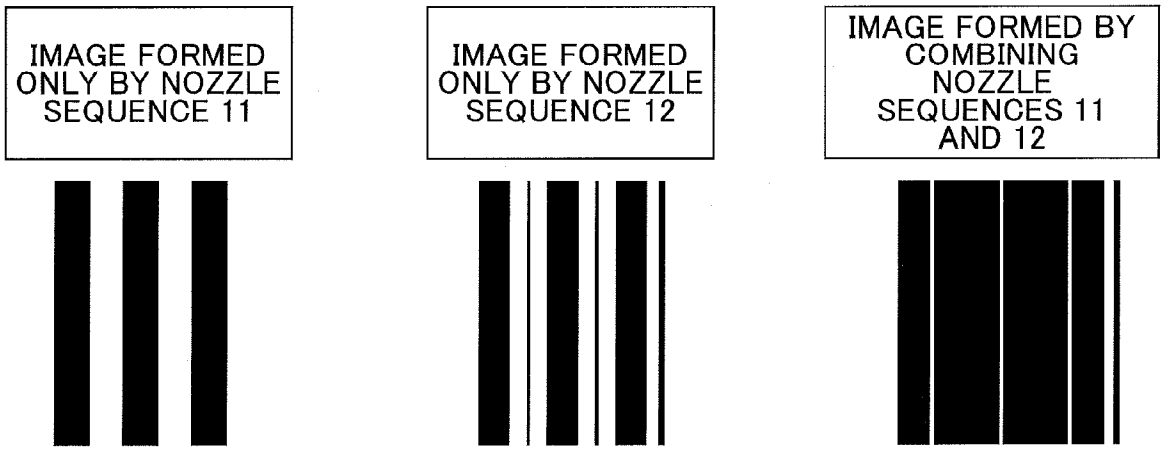
Figure 2:
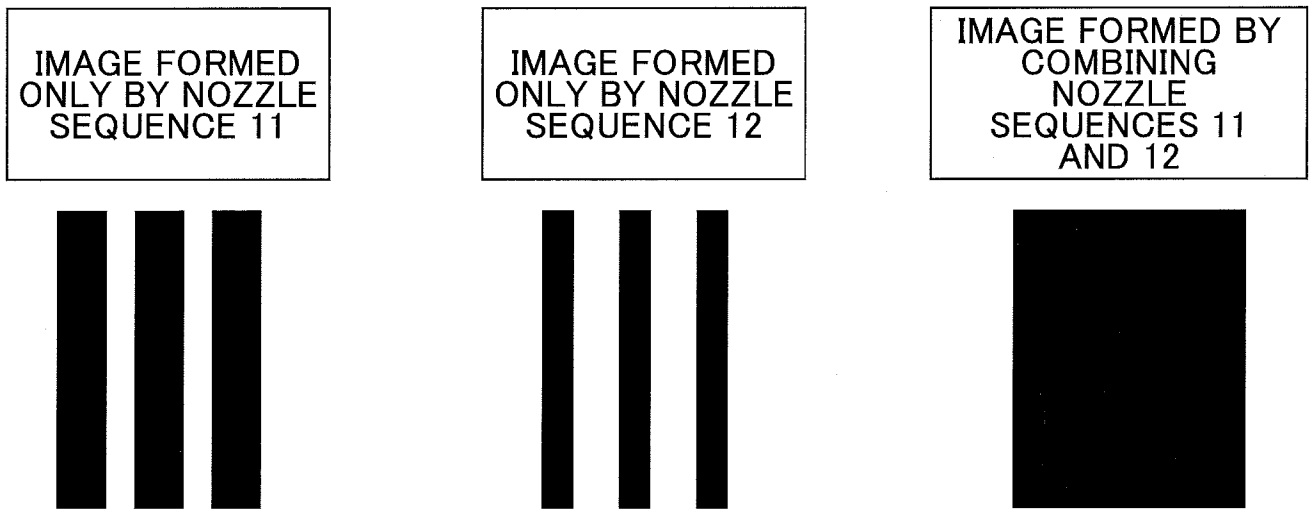
FIG. 2 is a second diagram for illustrating density adjustment process of the conventional recording head including the two nozzle sequences during an image formation process.
Figure 3A:
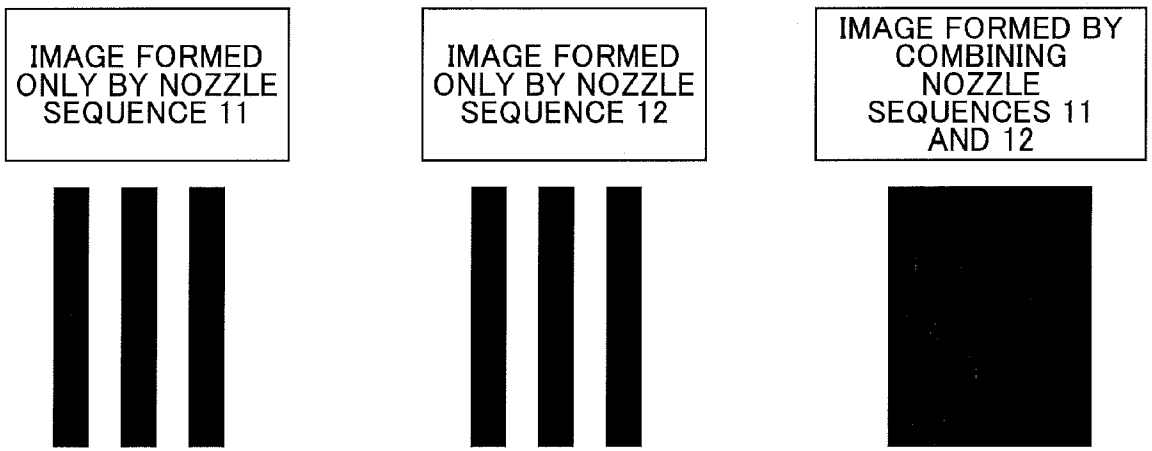
FIGS. 3A and 3B are diagrams illustrating cases where corresponding images are formed by combining plural nozzle sequences having the same discharging characteristics.
Figure 3B:
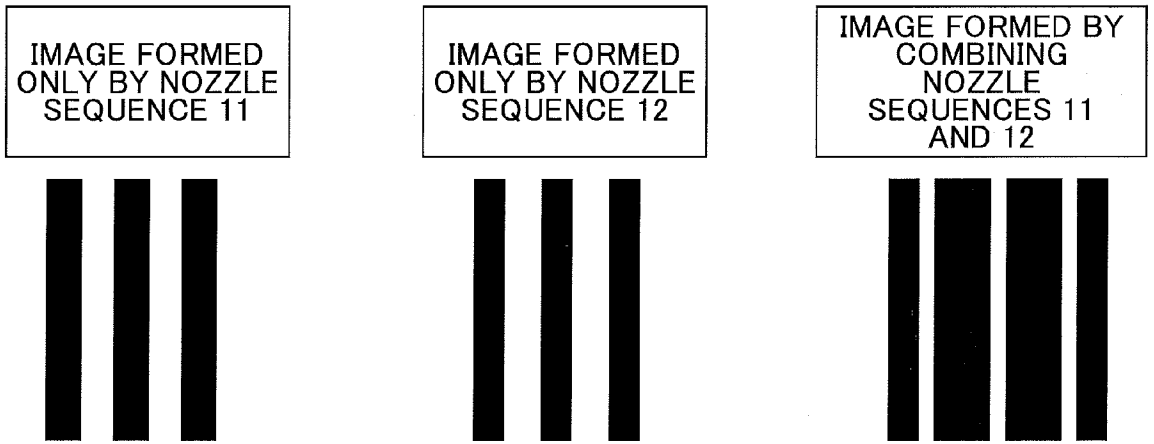
Figure 4:
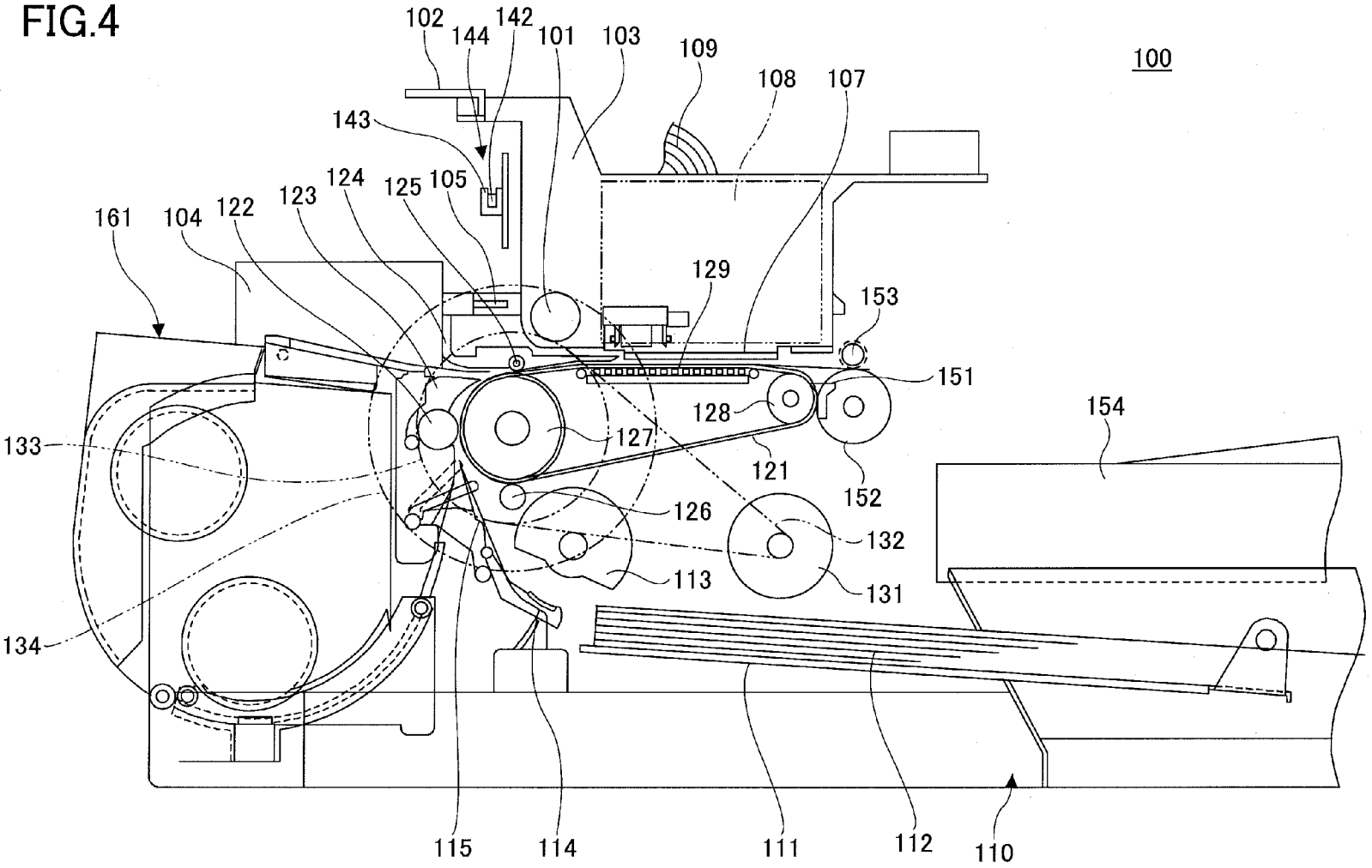
FIG. 4 is a first diagram illustrating a schematic configuration of an image forming apparatus according to a first embodiment.
Figure 5:
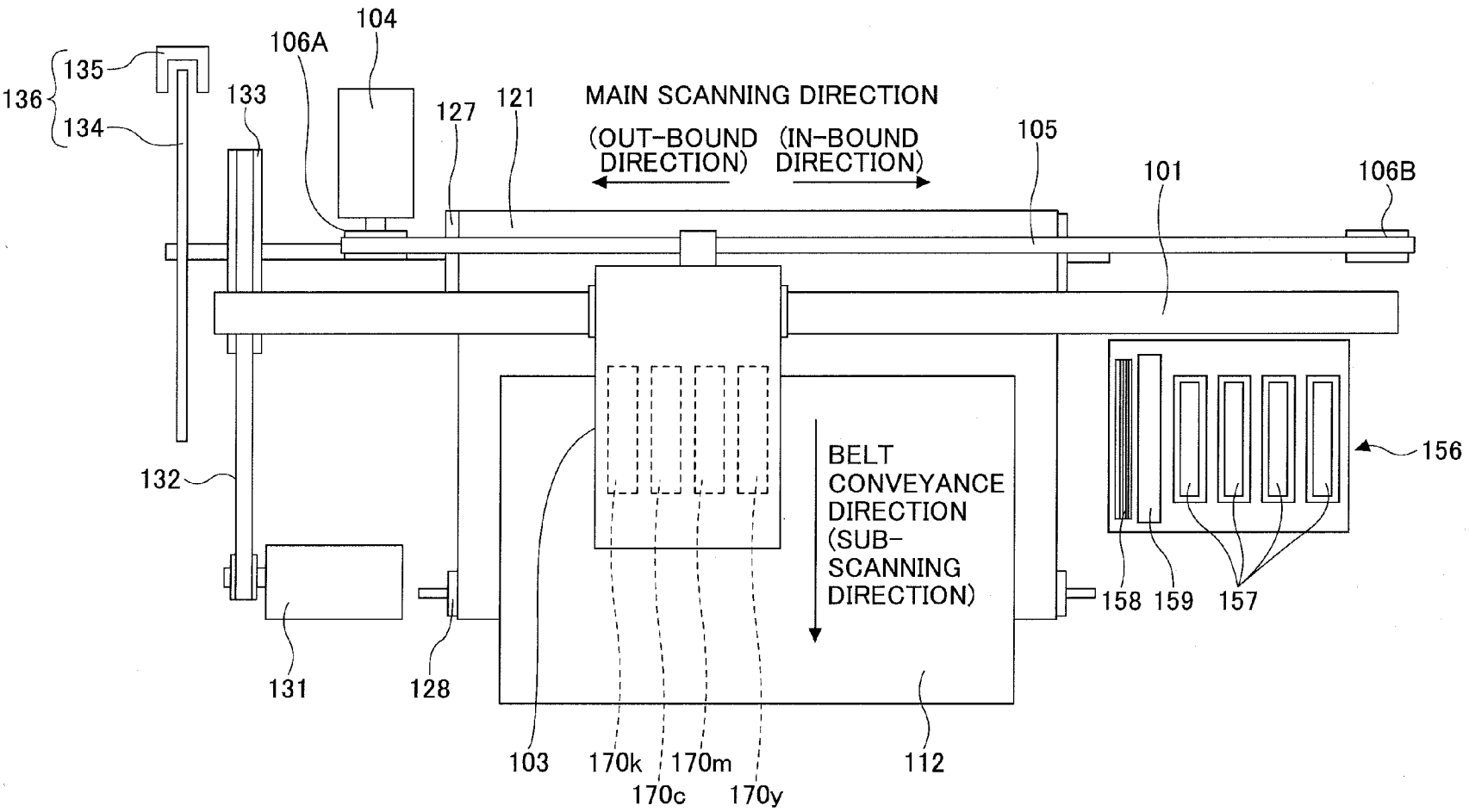
FIG. 5 is a second diagram illustrating the schematic configuration of the image forming apparatus according to the first embodiment.

Hereinafter, a first embodiment of the present invention will be explained, while referring to corresponding figures. FIG. 4 is a first diagram illustrating a schematic configuration of an image forming apparatus according to the first embodiment. FIG. 5 is a second diagram illustrating the schematic configuration of the image forming apparatus according to the first embodiment.

In the image forming device 100 according to the first embodiment, a carriage 103 is supported by a guide rode 101 and a guide rail 102 so that the carriage 103 can be slid in a main scanning direction. Here, the guide rod 101 and the guide rail 102 are supported by left and right side plates (not shown). The image forming device 100 moves the carriage 103 in the direction indicated by the arrows in FIG. 5 (the main scanning direction) by a main scanning motor 104 through a timing belt 105 suspended around a drive pulley 106A and a driven pulley 106B. Thereby, the carriage 103 is moved and scans in the direction indicated by the arrows in FIG. 5 (the main scanning direction).

The carriage 103 includes, for example, four recording heads 170*y*, 170*c*, 170*m*, and 170*k*, which include liquid discharging heads that discharge ink droplets in the corresponding colors of yellow (Y), cyan (C), magenta (M), and black (K). Here, when the colors are not distinguished, the recording heads 170*y*, 170*c*, 170*m*, and 170*k* are referred to as the recording heads 170. The recording heads 170 are mounted on the carriage 103, while plural ink discharging ports are arranged in a direction that intersects the main scanning direction. The ink droplet discharging direction is downwardly directed. Sub-tanks 108 for supplying the ink in the corresponding colors of yellow, cyan, magenta, and black to the corresponding recording heads 170 are mounted on the carriage 103. The ink in the corresponding colors is supplied from main tanks (ink cartridges) to the sub-tanks 108 through corresponding ink supply tubes 109. The main tanks are not shown in the figures.

As the liquid discharging head included in the corresponding recording head 170, a liquid discharging head having a pressure generating unit may be used. The pressure generating unit generates pressure for discharging liquid droplets. Examples of the pressure generating unit include a piezoelectric actuator such as a piezoelectric element; a thermal actuator including an electro-thermal conversion element such as a heating resistor that utilizes a phase transition caused by film boiling of a liquid; a shape memory alloy actuator that utilizes a metal phase transition due to a temperature change; and an electrostatic actuator that utilizes an electrostatic force.

Each of the recording heads 170 according to the first embodiment may include plural nozzle sequences for discharging single color ink. The nozzle sequences of the recording heads 170 of the image forming apparatus 100 according to the first embodiment will be described later.

The image forming apparatus 100 includes a paper feed unit such as a paper feed cassette 110 for feeding sheets of paper 112 stacked on a paper stacking unit (platen) 111. The paper feed unit includes a half-moon roller (paper feed roller) that feeds the sheets of paper 112 from the paper stacking unit 111 on a sheet-by-sheet basis; and a separation pad 114 that faces the paper feed roller 113 and that is formed of a material having a large friction coefficient. The separation pad 114 is biased toward the paper feed roller 113.

The sheet of paper 112 fed from the paper feeding unit is conveyed by a conveyance belt 121, a counter roller 122, a conveyance guide 123, and a pressing roller 125 that is biased by a pressing member 124 toward the conveyance belt 121. Additionally, the image forming apparatus 100 includes a charging roller that is a charging unit for electrically charging the surface of the conveyance belt 121.

The conveyance belt 121 is endless-belt-shaped, and the conveyance belt 121 is suspended around a conveyance roller 127 and a tension roller 128. When the conveyance roller 127 is rotated by a sub-scanning motor 131 through a timing belt 132 and a timing roller 133, the conveyance belt 121 circulates in a belt conveyance direction (the sub-scanning direction). A guide member 129 corresponding to an image forming region of the recording heads 170 is disposed on a rear side of the conveyance belt 121. The charging roller 126 contacts a front surface of the conveyance belt 121. The charging roller 126 is arranged so that it is rotated by the rotation of the conveyance belt 121.

A slit disk 134 and a sensor 135 that detects the slit of the slit disk 134 are attached to a rotational shaft of the conveyance roller 127. A rotary encoder 136 is formed by the slit disk 134 and the sensor 135.

The image forming apparatus 100 includes a paper discharging unit for discharging the sheets of paper 112 on which images are recorded by the recording heads 170. The paper discharging unit includes a separation pawl 151 that separates the sheet of paper 112 from the conveyance belt 121; paper discharging rollers 152 and 153; and a paper discharge tray 154 for storing the sheets of paper 112 that have been discharged.

Further, a double-sided paper feed unit 161 is detachably attached to a rear side of the image forming device 100. The double-sided paper feed unit 161 takes in the sheet of paper 112 that is returned by the rotation of the conveyance belt 121 in the reverse direction, and feeds the sheet of paper 112 again to a nip between the counter roller 122 and the conveyance belt 121.

Further, as shown in FIG. 5, the image forming device 100 includes a maintenance and recovery unit 156 for maintaining and recovering conditions of the nozzles of the recording heads 170. The maintenance and recovery unit 156 is disposed at one side in the main scanning direction of the carriage 103. The maintenance and recovery unit 156 includes caps 157 for capping the nozzle surfaces of the corresponding recording heads 170; a wiper blade 158 for wiping the nozzle surfaces; and an idle discharging receiving unit 159 that receives droplets which are discharged during idle discharge for discharging the droplets whose viscosity has been increased and that do not contribute to the recording.

In the image forming device 100 according to the first embodiment, the sheets of paper 112 are separately fed from the paper feed unit on a sheet-by-sheet basis, and the sheet of paper 112 that is fed upwardly in the vertical direction is guided by a guide 115. Subsequently, the sheet of paper 112 is conveyed while being nipped between the conveyance belt 121 and the counter roller 122. Further, a front tip of the sheet of the paper 112 is guided by the conveyance guide 123, and the sheet of the paper 112 is pressed onto the conveyance belt 121 by the pressing roller 125. Thereby, the conveyance direction of the sheet of paper 112 is changed by substantially 90 degrees.

At this time, a control unit (not shown) causes an alternating current (AC) bias supply unit to supply an alternating electric voltage to the charging roller 126. Here, in the waveform of the alternating electric voltage, positive voltage values and negative voltage values are alternately repeated. In this manner, the conveyance belt 121 is electrically charged to have an alternating charging voltage pattern. Namely, the conveyance belt 121 is electrically charged to have a pattern in which a positively charged area having a predetermined width and a negatively charged area having the predetermined width are alternately repeated in the sub-scanning direction, which is the circulating direction of the conveyance belt 121. When the sheet of paper 112 is fed onto the charged conveyance belt 121, the sheet of paper 112 is suctioned onto the conveyance belt 121 by the electrostatic force, and the sheet of paper 112 is conveyed in the sub-scanning direction by the circulating movement of the conveyance belt 121.

The recording heads 170 are driven in accordance with an image signal while the carriage 103 is moved in an out-bound direction and in an in-bound direction, and thereby the recording heads 170 discharge the ink onto the staying sheet of paper 112 and record an amount corresponding to one line. Subsequently, the sheet of paper 112 is conveyed by a predetermined amount, and the recording heads 170 record the next line. When the image forming apparatus 100 receives a recording termination signal or a signal indicating that a rear end of the sheet of paper 112 reaches a recording area, the image forming apparatus 100 terminates the recording operation, and discharges the sheet of paper 112 onto the paper discharge tray 154.

Further, when the image forming apparatus 100 according to the first embodiment performs duplex printing, upon termination of recording of an image onto a front surface (the surface on which the image is printed for the first time) of the sheet of paper 112, the sheet of paper 112, on which the image has already been recorded, is fed inside the double-sided paper feed unit 161 by rotating the conveyance belt 121 in the reverse direction. The sheet of paper 112 is reversed (so that the rear surface becomes the surface to be printed), and the sheet of paper 112 is again fed to the nip between the counter roller 122 and the conveyance belt 121. Then the timing control is performed, and similar to the above-described case, the sheet of paper 112 is conveyed by the conveyance belt 121. Subsequently, another image is recorded onto the rear surface, and the sheet of paper 112 is ejected onto the paper discharge tray 154.

Figure 6:
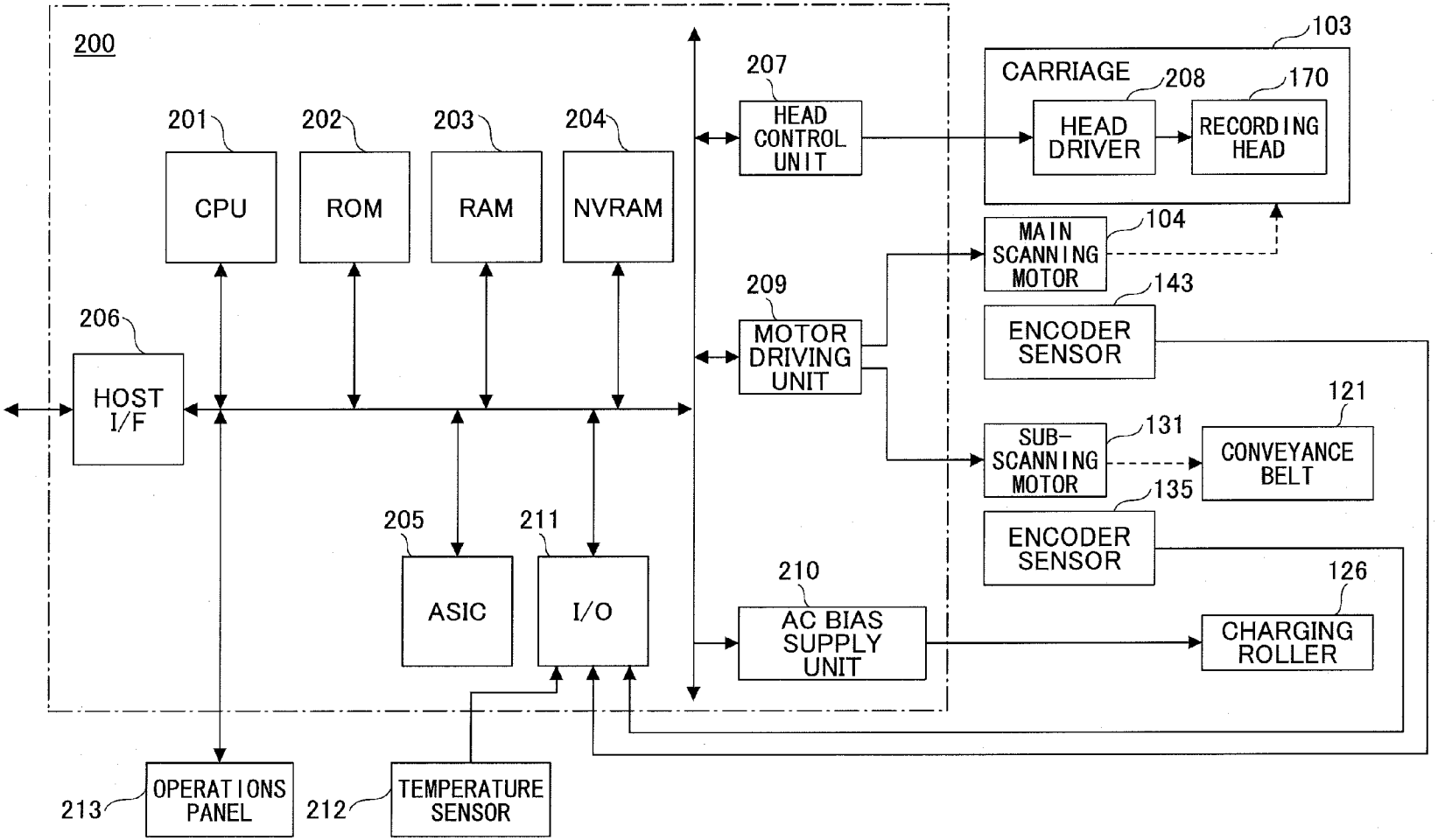
FIG. 6 is a block diagram schematically illustrating a print control unit of the image forming apparatus according to the first embodiment.

Next, there will be explained the print control unit 200 of the image forming apparatus 100 according to the first embodiment, while referring to FIG. 6. FIG. 6 is a block diagram showing a schematic configuration of the print control unit 200 of the image forming apparatus 100 according to the first embodiment.

The image forming apparatus 100 according to the first embodiment includes the print control unit 200 that controls the whole printing operations by the image forming apparatus 100, so that images are recorded on the sheets of paper 112.

The print control unit 200 includes a central processing unit (CPU) 201; a read-only memory (ROM) 202; a random access memory (RAM) 203; a non-volatile memory 204; an application specific integrated circuit (ASIC) 205; a host interface (I/O) 206; a head control unit 207; a motor drive unit 209; an AC bias supply unit 210; and an input/output (I/O) unit 211.

The CPU 201 is responsible for overall control of the image forming apparatus 100. The ROM 202 stores programs executed by the CPU 201 and other fixed data. The RAM 203 temporarily stores image data and the like. The non-volatile memory 204 maintains data while the power supply of the image forming apparatus 100 is shut down. The data stored in the non-volatile memory 204 can be overwritten.

The ASIC 205 performs various types of signal processing of the image data, performs image processing such as sorting, and processes an input signal and/or an output signal for controlling the whole of the image forming apparatus 100. The host I/F 206 transmits data and/or a signal to a host, and receives data and/or a signal from the host. Here, the host is, for example, a computer to which the image forming apparatus 100 is connected.

The head control unit 207 transmits data for driving and controlling the recording heads 170, generates a driving waveform, and corrects a driving waveform. In the image forming apparatus 100 according to the first embodiment, the head control unit 207 generates profiles of the corresponding nozzle sequences included in the recording head 170, and the head control unit 207 corrects a driving signal based on a relationship among discharging characteristics of the corresponding nozzle sequences. Here, the relationship is obtained from the profiles. Details of the head control unit 207 will be explained later.

The motor drive unit 209 drives the main scanning motor 104 and the sub-scanning motor 131. The AC bias supply unit 210 supplies an AC bias to the charging roller 126. The I/O unit 211 inputs detection signals from an encoder sensor 143 and the sensor 135 to the print control unit 200. The I/O unit 211 also inputs detection signals from various sensors such as a temperature sensor 212 that detects an environmental temperature to the print control unit 200. The print control unit 200 is connected to an operations panel 213 for inputting information to the image forming apparatus 100 and for displaying information regarding the image forming apparatus 100.

The print control unit 200 receives image data and the like from the host by the I/F 206 through a cable or a network. Examples of the host include an information processing device such as a personal computer, an image reading device such as an image scanner, and an imaging device such as a digital camera.

The CPU 201 of the image forming apparatus 200 reads out and analyzes image data in a receive buffer included in the host I/F 206. After that, the ASIC 205 performs, for example, image processing and sorting of the data. The processed printing data is transferred from the head control unit 207 to a head driver 208. Incidentally, dot-pattern data (printing data) for outputting the image may be generated by a printer drive included in a post-processing host.

The head control unit 207 transmits the printing data as serial data to the head driver 208. At this time, the head control unit 207 outputs, for example, a transfer clock for transferring the printing data and for determining transfer of the printing data; a latch signal; and a droplet control signal (mask signal) to the head driver 208. The head control unit 207 includes a drive waveform generating unit and a drive waveform selection unit. The drive waveform generating unit includes a D/A converter that digital-to-analog converts pattern data for a driving signal stored in the ROM 202, a voltage amplifier, and an electric current amplifier. The driving waveform selection unit selects a drive waveform input to the head driver 208. The head control unit 207 generates the drive waveform and outputs the drive waveform to the head driver 208. The drive waveform may include a single drive pulse (drive signal) or plural drive pulses (drive signals).

The head driver 208 selectively applies the drive signal received from the head control unit 207 to drive elements (for example, the above-described piezoelectric elements) of the recording heads 170, based on the serially input printing data corresponding to an amount of one line formed by the recording heads 170. The recording heads 170 selectively apply dots having different sizes, such as large droplets (large dots), medium droplets (medium dots), and small droplets (small dots), based on the drive signal applied to the drive elements.

Hereinafter, there will be explained the recording head 170 according to the first embodiment, while referring to FIG. 7. The recording head 170 included in the image forming apparatus 100 according to the first embodiment forms an image by discharging single color ink from plural nozzle sequences.

Figure 7:
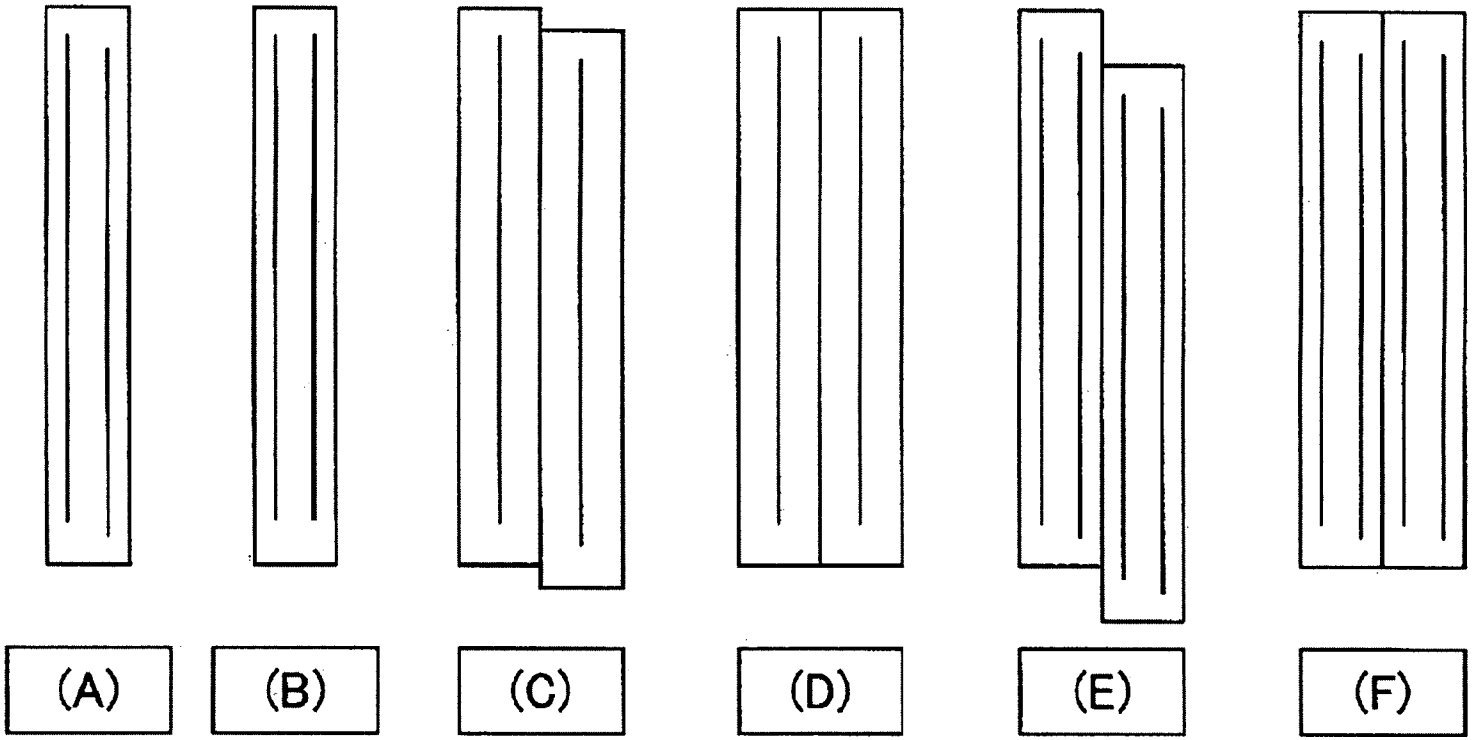
FIG. 7 is a diagram illustrating examples of arrangements of the plural nozzle sequences.

FIG. 7 is a diagram illustrating examples of arrangements of the plural nozzle sequences. In FIG. 7, (A) is an example where the plural nozzle sequences are staggered within one recording head. With the configuration of (A) in FIG. 7, recording density may be improved compared to that of a recording head having a single nozzle sequence.

In FIG. 7, (B) is an example where the plural nozzle sequences are arranged in parallel within one recording head. When the nozzle sequences are arranged in accordance with the configuration (B) in FIG. 7, the resolution in the longitudinal since the nozzle sequences are arranged in parallel at positions where the nozzle sequences overlap, the resolution in a direction perpendicular to the longitudinal direction of the head is improved. For example, if a time interval between a time at which one of the plural nozzle sequences can form dots and a time at which the other one of the plural nozzle sequences can form dots is X, the resolution can be twice improved by shifting the discharge timing of the one of the nozzle sequences by X/2 and shifting the discharge timing of the other one of the nozzle sequences by X/2.

Further, in the configuration of (B) in FIG. 7, some dots are formed by one of the nozzle sequences and other dots are formed by the other one of the nozzle sequences. Therefore, even if a discharging failure occurs in one of the nozzle sequences, the dots can be interpolated by the other one of the nozzle sequence. Therefore, missing of the dots can be prevented, and the image failure may be unnoticeable.

In an example (C) of FIG. 7, the nozzle sequences are arranged similar to the configuration (A) in FIG. 7 by providing plural recording heads. Here, each of the recording heads includes a single nozzle sequence. Similarly, in an example (D) of FIG. 7, the nozzle sequences are arranged similar to the configuration (B) in FIG. 7 by providing plural recording heads where each of the recording heads includes a single nozzle sequence. An example (E) of FIG. 7 is a combination the configuration (B) and the configuration (C) of FIG. 7. In the configuration (E) of FIG. 7, two recording heads according to the example (B) are staggered. An example (F) of FIG. 7 is a combination of the configuration (A) and the configuration (D) of FIG. 7. In the configuration (F) of FIG. 7, two recording heads according to the example (A) are arranged in parallel.

In FIG. 7, the maximum number of the nozzle sequences included in the recording head is two. However, the number of the nozzle sequences included in the recording head is not limited to this. The number of the nozzle sequences included in the recording head may be greater than two. Additionally, the order of the arrangement of the nozzle sequences may be changed. A nozzle sequence that discharges ink having a different color may be arranged in the plural nozzle sequences that discharge the single color ink.

In the explanation below, it is assumed that the recording head 170 according to the first embodiment has the configuration (A) in FIG. 7 or the configuration (B) in FIG. 7. Namely, the recording head 170 according to the first embodiment includes two nozzle sequences.

Figure 8:
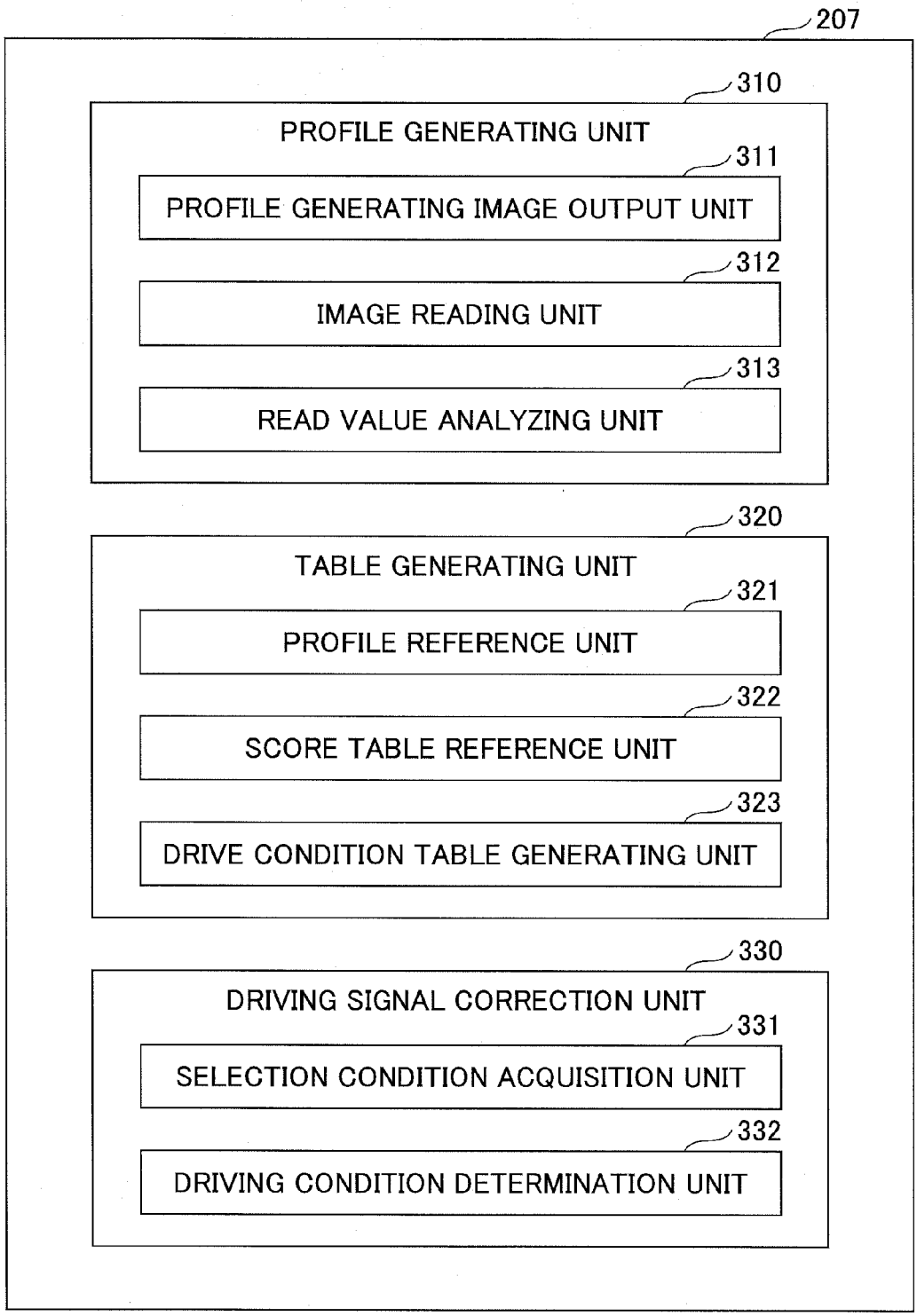
FIG. 8 is a diagram showing an example of a functional configuration of a head control unit according to the first embodiment.

The head control unit 207 according to the first embodiment generates the profiles of the corresponding nozzle sequences. The drive signal applied to the recording head 170 is corrected based on the relationship between the discharging characteristics of the corresponding nozzle sequences. The discharging characteristics are obtained from the corresponding profiles. Hereinafter, there will be explained the head control unit 207 according to the first embodiment. FIG. 8 is a diagram showing an example of a functional configuration of the head control unit 207 according to the first embodiment.

The head control unit 207 according to the first embodiment includes a profile generating unit 310; a table generating unit 320; and a driving signal correction unit 330. In the head control unit 207, the profile generating unit 310 causes the recording head 170 to operate under driving conditions corresponding to plural patterns, and thereby the profile generating unit 310 generates the profiles. Here, each of the profiles includes information indicating a relationship between the discharging characteristic and the position of the corresponding nozzle sequence.

The table generating unit 320 scores the profiles corresponding to the driving conditions, and generates a drive condition table in which the driving conditions are associated with the scores. The driving signal correction unit 330 corrects the driving signal supplied to the head driver 208 based on the driving condition selected from the driving condition table. In the first embodiment, the driving condition includes information regarding voltage values and timings of the drive signals supplied to the corresponding nozzle sequences of the recording head 170.

The profile generating unit according to the first embodiment includes a profile generating image output unit 311; an image reading unit 312; and a read value analyzing unit 313.

The profile generating image output unit 311 outputs, for each nozzle of the recording head 170, a profile generating image. Specifically, the profile generating image output unit 311 supplies profile generating image data to the recording head 170 through the head driver 208. The profile generating image data may be stored, for example, in the ROM 202 and/or in the RAM 203. The profile generating image is an image having a predetermined pattern. The details of the profile generating image will be explained later.

The image reading unit 312 reads the profile generating image. In the image forming apparatus 100 according to the first embodiment, a sensor for reading an image recorded by the recording head 170 may be included in the carriage 103, for example. The image reading unit 312 according to the first embodiment reads an output value of the sensor as an image formed by the nozzle.

The read value analyzing unit 313 analyzes the output value of the sensor that has been read by the image reading unit 312, and generates a profile of the corresponding nozzle sequence. In the first embodiment, the profile includes various types of information regarding the characteristics of the nozzle sequence that are obtained by analyzing the output value of the sensor that has been read by the image reading unit 312. Items of the information included in the profile will be explained later. The generated profile may be stored as profile data in a predetermined storing region that is formed, for example, by the ROM 202 and the RAM 203.

The table generating unit 320 according to the first embodiment includes a profile reference unit 321; a score table reference unit 322; and a drive condition table generating unit 323. The profile reference unit 321 refers to the profile data stored in the storing region. The score table reference unit 322 refers to the score table stored in the storing region. The detail of the score table will be described later.

The drive condition table generating unit 323 generates the drive condition table based on the profile data and the score table. In the drive condition table, the drive conditions are associated with the corresponding profile data. The details of the drive condition table will be explained later.

The driving signal correction unit 330 includes a selection condition acquisition unit 331 and a driving condition determination unit 332. The selection condition acquisition unit 331 obtains a selection condition for determining the drive condition, for example, based on the setting of the image forming apparatus 100. The driving condition determination unit 332 determines the driving condition of the recording head 170 based on the selection condition by referring to the driving condition table.

Hereinafter, there will be explained a profile generating method by the profile generating unit 310 in the image forming apparatus 100 according to the first embodiment.

Figure 9:
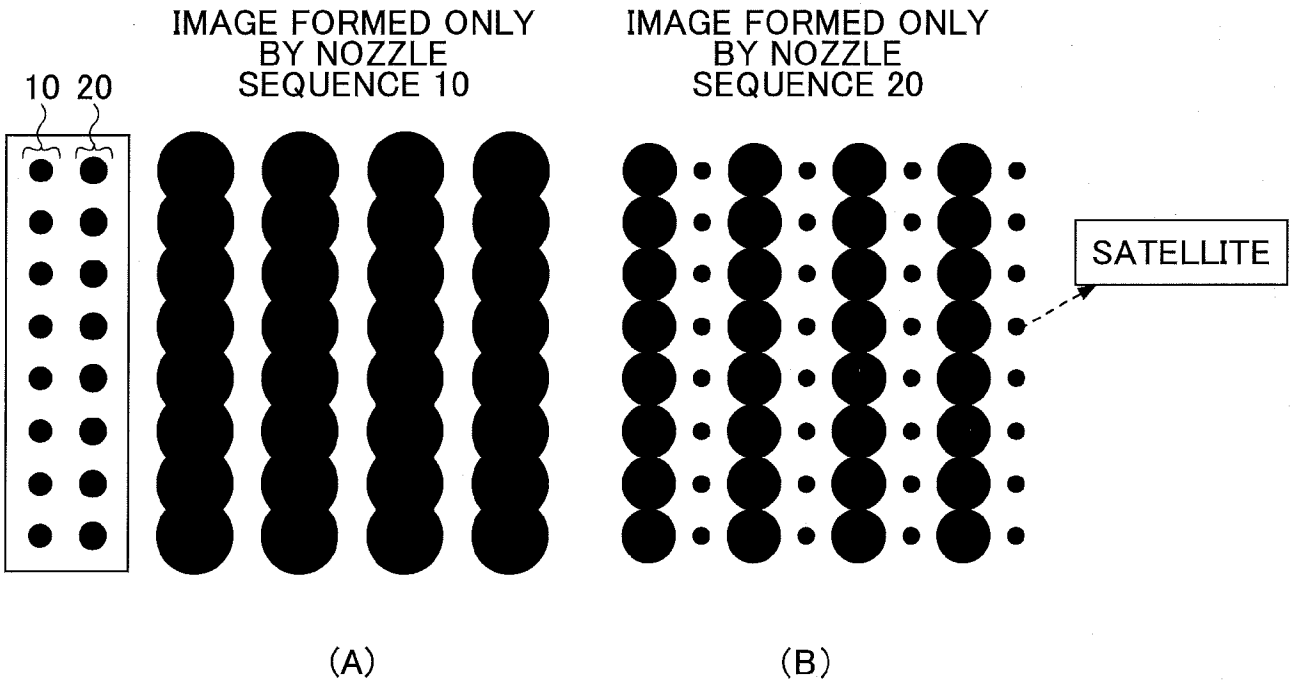
FIG. 9 is a diagram showing a first example of a profile generating image formed by nozzle sequences of a recording head according to the first embodiment.

FIG. 9 is a diagram showing a first example of the profile generating image formed by the nozzle sequences in the recording head 170 according to the first embodiment. The first example of FIG. 9 is the profile generating image formed by alternately discharging the ink from the two nozzle sequences included in the recording head 170. According to the first embodiment, in the profile generating unit 310 of the head control unit 207, the profile generating image output unit 311 outputs the profile generating image data, and thereby the profile generating image is formed.

Hereinafter, in the explanation of the first embodiment, the two nozzle sequences included in the recording head 170 are referred to as a nozzle sequence 10 and a nozzle sequence 20, respectively. In FIG. 9, (A) indicates the profile generating image formed only by the nozzle sequence 10. Similarly, (B) indicates the profile generating image formed only by the nozzle sequence 20. Both the nozzle sequences 10 and 20 utilize the line shaped images as the profile generating image.

In the example of FIG. 9, the size of the main ink droplet in the profile generating image formed by the nozzle sequence 20 is smaller than that of the profile generating image formed by the nozzle sequence 10. Further, in the profile generating image formed by the nozzle sequence 20, isolated images are observed. The isolated images are generated by small droplets that are unintentionally discharged from the nozzles apart from the corresponding main droplets. Hereinafter, such small droplets will be referred to as "satellites."

Figure 10A:
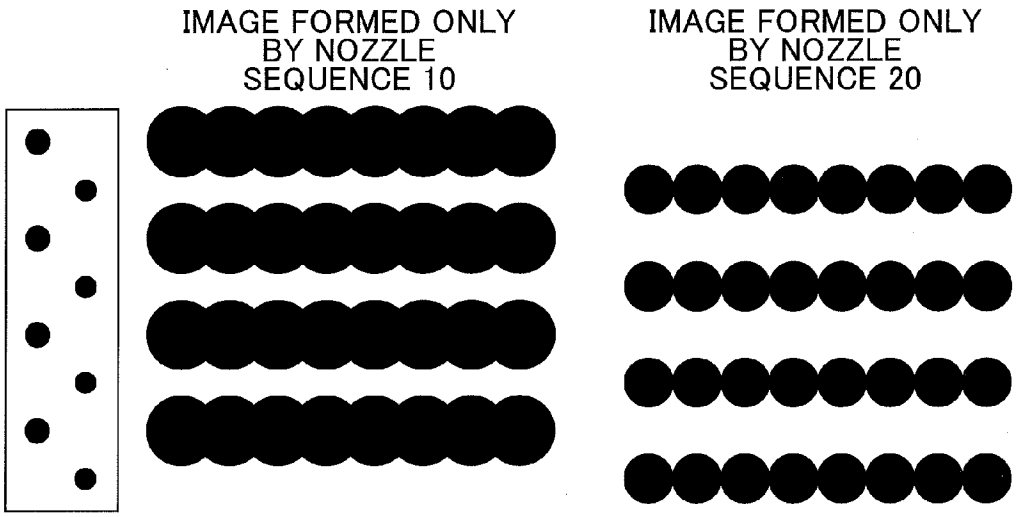
FIG. 10A is a diagram showing a second example of the profile generating images formed by the corresponding nozzle sequences of the recording head according to the first embodiment.
Figure 10B:
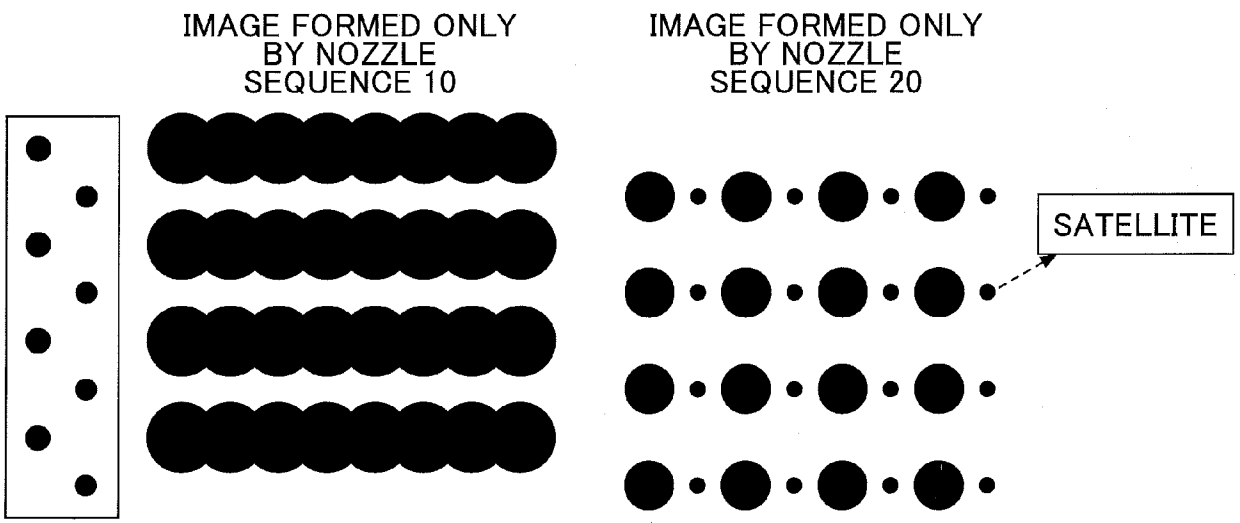
FIG. 10B is a diagram showing a second example of the profile generating images formed by the corresponding nozzle sequences of the recording head according to the first embodiment.

Next, there will be explained a case where the profile generating images are output by the two nozzle sequences 10 and 20 that are staggered. FIGS. 10A and 10B are diagrams showing second examples of the profile generating images that are formed by the nozzle sequences 10 and 20 included in the recording head 170 according to the first embodiment.

FIGS. 10A and 10B show an arrangement of the nozzle sequence 10 and the nozzle sequence 20 where the nozzles of the nozzle sequence 10 and the nozzles of the nozzle sequence 20 are staggered. With such an arrangement, dots are formed along plural horizontal lines shown in FIGS. 10A and 10B by the corresponding nozzles of the nozzle sequences 10 and 20. On each of the horizontal lines shown in FIG. 10A, the dots are formed only by the corresponding nozzle. Similarly, on each of the horizontal lines shown in FIG. 10B, the dots are formed only by the corresponding nozzle. Therefore, when a pattern shown in FIG. 10A (a pattern in which the dots are continuously formed in the direction (the horizontal direction in FIG. 10A) in which the dots are formed) is utilized as the profile generating image, even if the satellites occur, since the satellites are overwritten by the main dots, the satellites will not be detected.

Therefore, when the nozzle sequences 10 and 20 are arranged as shown in FIGS. 10A and 10B, where the nozzles of the nozzle sequence 10 and the nozzles of the nozzle sequence 20 are staggered, it is preferable to use a profile generating image as shown in FIG. 10B, where the dots are not continuously formed in the direction (the horizontal direction in FIG. 10B) in which the dots are formed.

In the head control unit 207 according to the first embodiment, the image reading unit 312 of the profile generating unit 310 causes a sensor or the like to read a profile generating image, and thereby the head control unit 207 obtains output values of the sensor. In the first embodiment, the output values of the sensor are values indicating the density of the profile generating image.

Figure 11B:
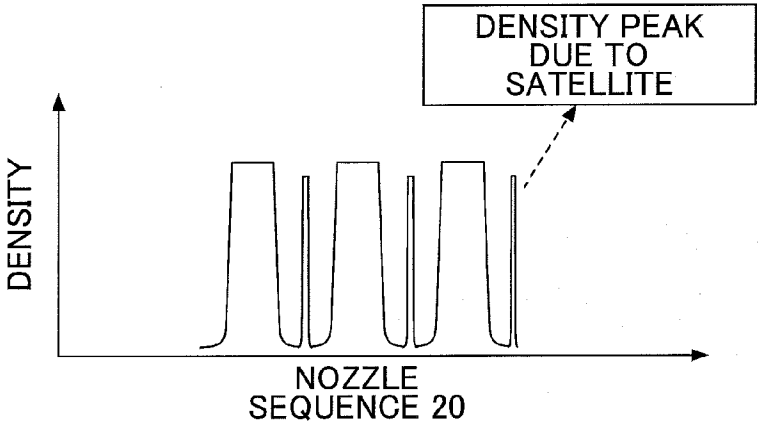
FIG. 11B is a diagram showing an example of output values of the sensor that is read by the image reading unit according to the first embodiment.
Figure 11A:
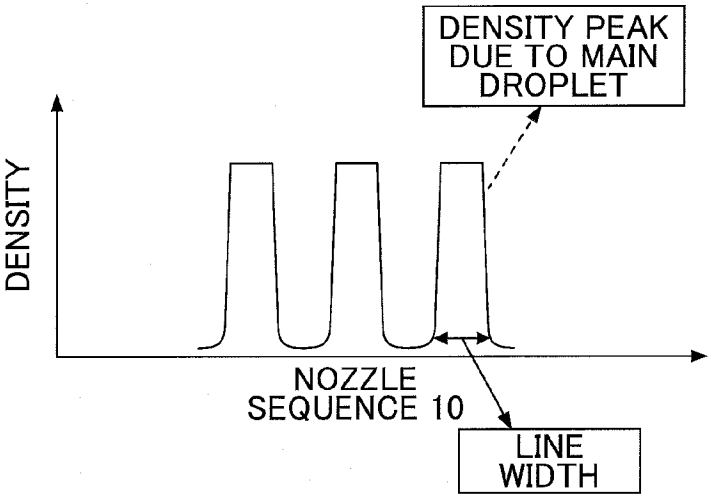
FIG. 11A is a diagram showing an example of output values of a sensor that is read by an image reading unit according to the first embodiment.

FIGS. 11A and 11B are diagrams showing examples of the output values of the sensor that have been read by the image reading unit 312 according to the first embodiment. FIG. 11A shows first output values of the sensor when the sensor reads the profile generating image that has been output by the nozzle sequence 10. FIG. 11B shows second output values of the sensor when the sensor reads the profile generating image that has been output by the nozzle sequence 20. Here, the first output values indicate the density of the profile generating image that has been output by the nozzle sequence 10. The second output values indicate the density of the profile generating image that has been output by the nozzle sequence 20.

Since peaks of the density corresponding to the image can be observed in the output values as shown in FIGS. 11A and 11B, the read value analyzing unit 313 can find the widths of the lines from the widths of the bottoms of the peaks in the profiles. Additionally, the read value analyzing unit 313 can find the density of the profile generating image from the height of the peak. In the first embodiment, the density may be defined to be the heights of the peaks. Alternatively, in the first embodiment, an average density value within a predetermined range may be calculated by averaging the heights of the peaks.

As shown in FIG. 11B, when the satellites occur, peaks can be observed in the profile. The peaks are different from peaks corresponding to the main droplets. The distance between the peaks corresponding to the main droplets may be found in advance from image data for generating the profile generating image. Therefore, the read value analyzing unit 313 may determine the presence or absence of a satellite by searching for a peak placed between the neighboring peaks corresponding to the neighboring main droplets. In the read value analyzing unit 313, for example, a threshold value of a line width and a threshold value of a peak for determining the presence or absence of a satellite may be defined in advance. At this time, the read value analyzing unit 313 may determined that a peak having a line width that is smaller than or equal to the threshold value is caused by a satellite. Alternatively or additionally, the read value analyzing unit 313 may determine that a peak having a density value that is less than or equal to the threshold value is caused by a satellite.

Further, the read value analyzing unit 313 according to the first embodiment may read the positional information of the nozzle sequence 10 by finding the difference between a target value and the distance between the neighboring peaks that correspond to the neighboring lines formed by the nozzle sequence 10. Similarly, the read value analyzing unit 313 may read the positional information of the nozzle sequence 20 by finding the difference between the target value and the distance between the neighboring peaks that correspond to the neighboring lines formed by the nozzle sequence 20.

The image reading unit 312 according to the first embodiment may read the profile generating image two-dimensionally. With the two-dimensional information, a satellite may be detected as a dot. Additionally, the density and an amount of the satellite may be found from a paper surface covering amount, which is obtained by integrating the density value in a predetermined area.

Further, the shape of the profile generating image is not limited to a line shape. For example, the shape of the profile generating image may be a dot shape. At this time, since the dots are separated, when the profile is two-dimensionally read, shape information such as an outer circumference length and circularity of the main droplet and the satellite may be obtained.

Next, there will be explained a case where the nozzle sequence 10 and the nozzle sequence 20 are combined.

As a profile of a case where plural nozzle sequences are combined, density information of an image formed by combining the plural nozzle sequences is obtained. Especially, for a solid image, when the density is insufficient, it is difficult to increase the density by another correction method. Therefore, it is preferable that a sufficient correction be performed during setting up of the driving conditions.

For example, as another method of correcting the density, a method is considered in which an input-output characteristic of the image processing is changed. The density can be corrected by correcting the output relative to the input, such as the cases of the gamma correction and the color matching. However, these are method of adjusting the amount of the ink used in the dot to be applied relative to the input. Therefore, the density can be adjusted in the direction to reduce the amount of the ink used for the dot. The color (density) can be adjusted at a halftone level where an adhering amount of the ink can be increased. However, in the solid image, the maximum applicable amount of the ink is adhered. Therefore, it is not possible to increase the density of the solid image. Thus, the density of the solid image is corrected by correcting the characteristic of the droplets to be discharged.

The adhering positions of the dots discharged from the plural nozzle sequences are important for correctly finding the density of the solid image. When the driving conditions of the corresponding nozzle sequences are not defined, the positional relationship between the two sequences of the dots is not fixed. Therefore, in such a case, the environment for detecting the density is not established.

Hereinafter, there will be explained two methods of obtaining the density, when the positional relationship of the two sequences of the dots has been fixed.

In the first method, ink droplets are discharged from plural nozzle sequences. A profile generating image, in which the dots are combined, is directly printed, and the characteristic is detected.

The first method utilizes the fact that the covering area of the two sequences of ink dots is enlarged when the positions of the plural nozzle sequences are correctly aligned.

In this case, plural patterns of profile generating images are printed, under corresponding plural conditions where voltage values of driving signals supplied to the corresponding nozzle sequences and conditions on the positional relationship of the dots discharged from the corresponding nozzle sequences are combined. Then, distribution of density variations of the plural patterns of profile generating images is observed. In this manner, the condition is detected under which the positional relationship of the dots discharged from the corresponding nozzle sequences is optimized and the corresponding density.

Figure 12:
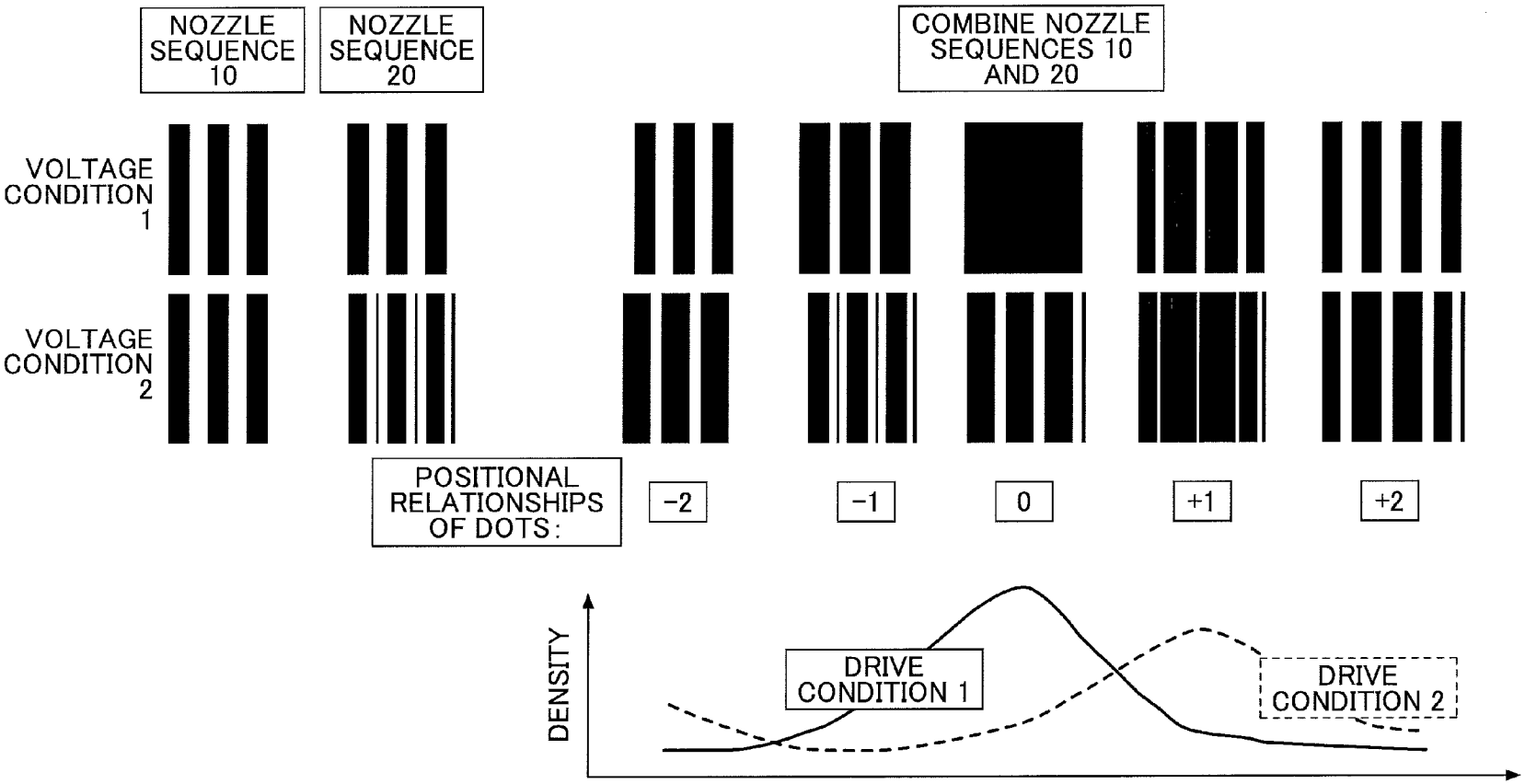
FIG. 12 is a first diagram illustrating acquisition of density values of the profile generating images formed by a combination of the plural nozzle sequences according to the first embodiment.

FIG. 12 is a first diagram illustrating acquisition of the density values of the profile generating images formed by the combination of the plural nozzle sequences according to the first embodiment.

In FIG. 12, there is output the profile generating images where the positional relationship of the two sequences of the dots are varied, while setting the voltage condition of the nozzle sequences to be a voltage condition 1 and a voltage condition 2. Here, the voltage condition indicates voltage values of the driving signals supplied to the corresponding nozzle sequences. The positional relationship of the two sequences of the dots can be varied by varying the timing to discharge the ink droplets from the nozzle sequence 10 and the timing to discharge the ink droplets from the nozzle sequence 20. Namely, by controlling the timing to supply the driving signals to the nozzle sequence 10 and the timing to supply the driving signals to the nozzle sequence 20, the positional relationship of the two sequences of the dots can be varied.

FIG. 12 shows cases where, for the first voltage condition and for the second voltage condition, five patterns of profile generating images are output. The positional relationship of the two sequences of the dots is relatively varied in the in FIG. 12, the five patterns of the profile generating images are indicated by the corresponding positional relationships of the dots. The corresponding positional relationships of the dots are indicated by −2, −1, 0, 1, 2, respectively. The information regarding the positional relationships (hereinafter, referred to as the positional relation information) for outputting the five patterns of the profile generating images is stored in advance in a storing area such as the ROM 202 or the RAM 203.

In FIG. 12, for the case of the voltage condition 1, when the positional relation information is 0, the density value for the case where the two sequences of the dots are combined becomes the highest value. Therefore, it is determined that the positioning of the two sequences of the dots is optimized when the positional relation information is 0. Namely, for the voltage condition 1, it is determined that the driving signals are supplied to the nozzle sequence 10 and to the nozzle sequence 20 at appropriate timings, when the positional relation information is 0.

In FIG. 12, for the case of the voltage condition 2, when the positional relation information is +1, the density value becomes the highest value. Therefore, it is determined that the positioning of the two sequences of the dots is optimized when the positional relation information is +1.

Next, there will be explained the second method of obtaining the density values during a state where the positional relationship of the two sequences of the dots has been fixed. In the second method, the density is estimated from the profiles that are obtained from the profile generating images of the corresponding nozzle sequences.

Figure 13:
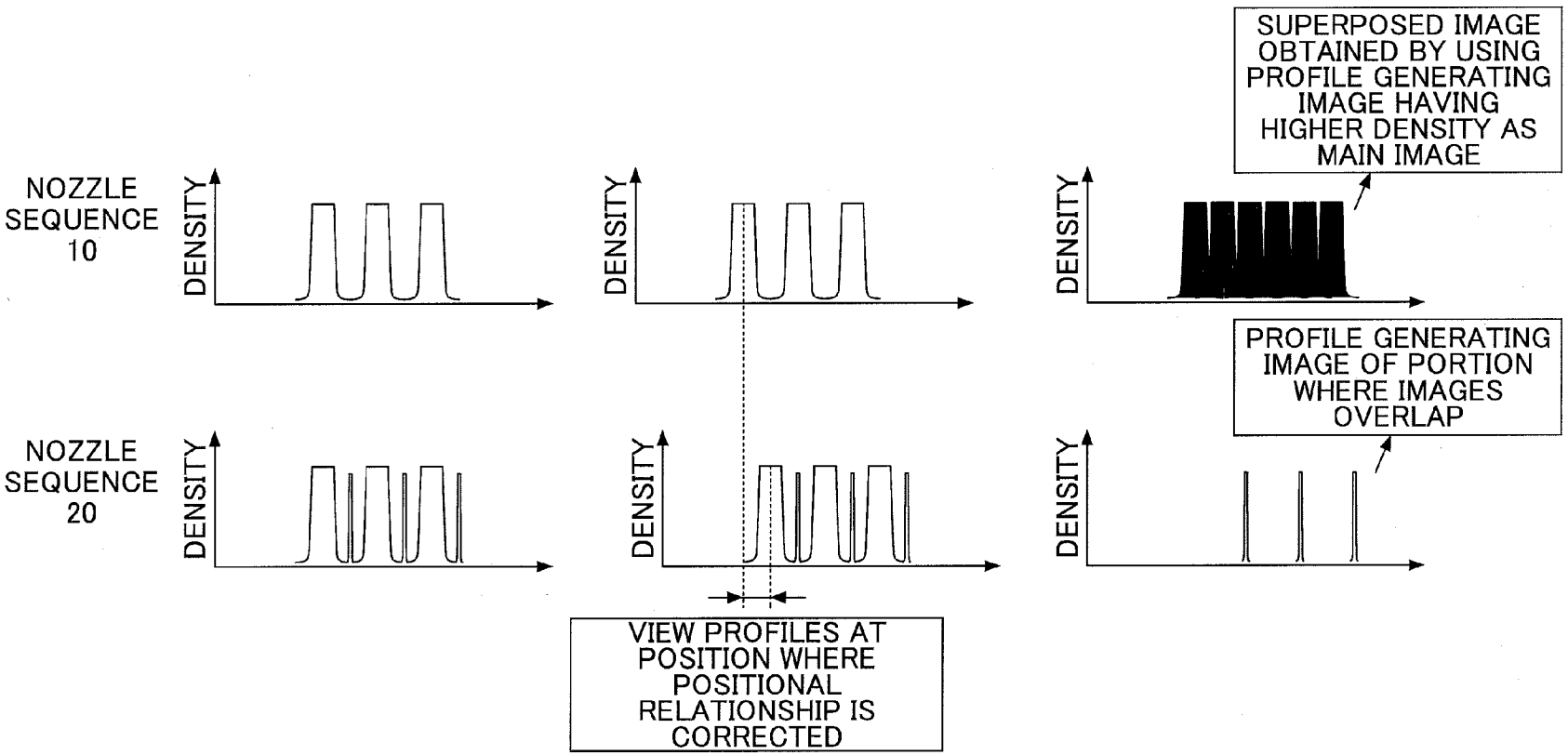
FIG. 13 is a second diagram illustrating the acquisition of the density values of the profile generating images formed by the combination of the plural nozzle sequences according to the first embodiment.

FIG. 13 is a second diagram illustrating the acquisition of the density values of the profile generating images formed by the combination of the plural nozzle sequences according to the first embodiment.

In the method shown in FIG. 13, the profile generating images of the corresponding nozzle sequences are superposed based on the output values obtained from the profile generating images generated for one of the nozzle sequences and for the other nozzle sequence, as shown in FIG. 11, and the positional relation information of the two sequences of the dots. In this case, the two profile generating images may be superposed while setting one of the profile generating images having the higher density value as a main image. Further, the two profile generating images may be superposed by adding the profile generating image for the other nozzle sequence to the profile generating image having the higher density value, while assigning a smaller weight coefficient to the portion of the profile generating image for the other nozzle sequence where the dots overlap the other dots.

The density value of the image is substantially determined by the coverage of the paper surface. Therefore, there is little contribution from the portion where the dots overlap to the density increment. In the method explained by referring to FIG. 12, the calculation has been simplified by ignoring the portion where the dots overlap. On the other hand, in the method explained by referring to FIG. 13, the overlap of the dots has been considered.

In the first embodiment, it has been explained that the profile processing is performed while setting the output values of the sensor to be the density values. However, the profile processing is not limited to this. For example, preprocessing such as smoothing or filtering, in which only the values that are greater than a reference level are processed, may be applied to the output values of the sensor. For example, preprocessing such as smoothing or filtering, in which only the values that are greater than a reference level are processed, may be applied to the output values of the sensor. Especially, in order to reduce the effect of the variation of the density of the paper surface, it is preferable to process a profile that has been offset by a value that is greater than the variation of the density. Further, instead of processing the profile as continuous data, the profile may be processed while the profile is binarized or multi-valued.

Figure 14:
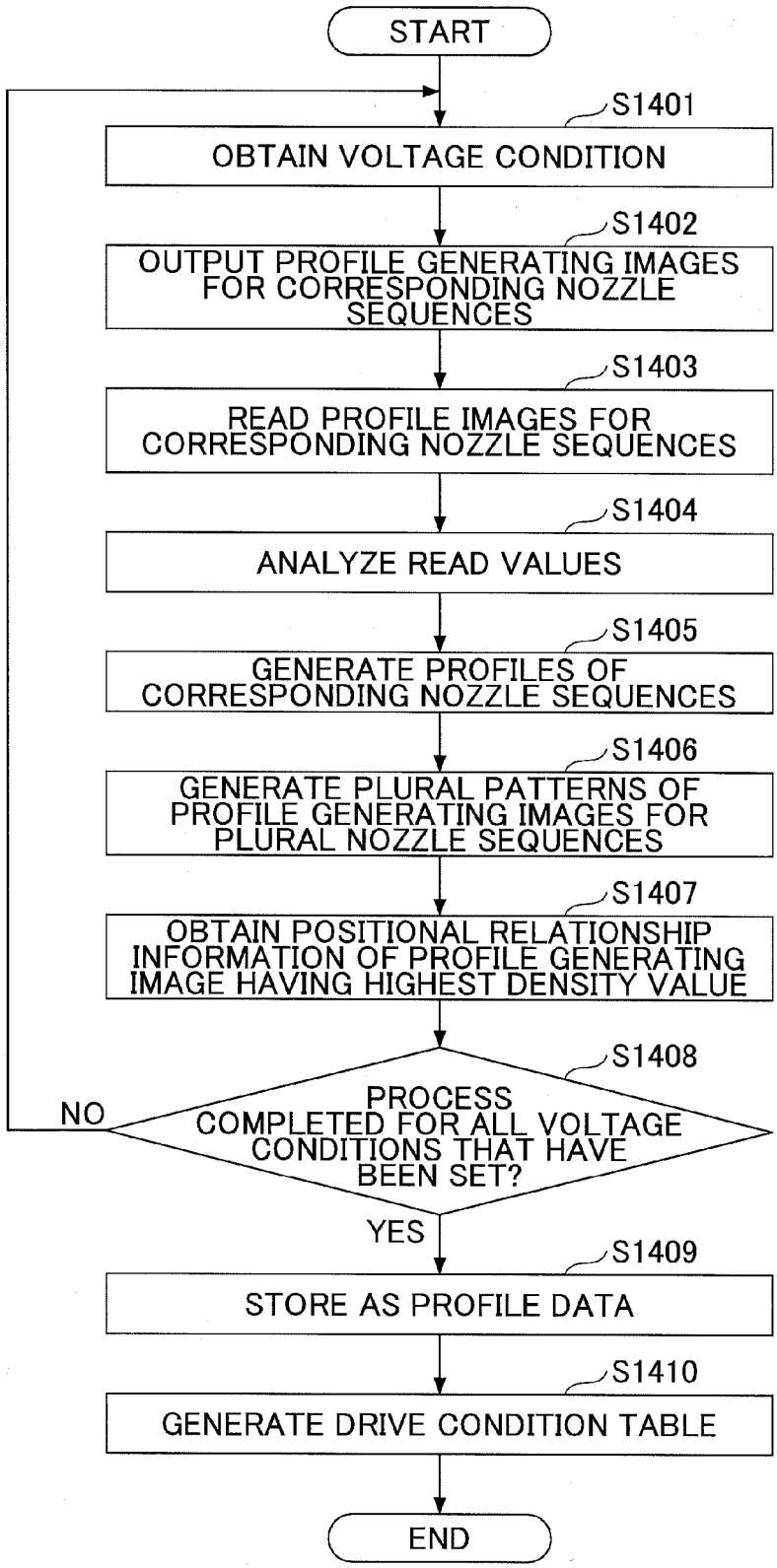
FIG. 14 is a flowchart illustrating operations of a profile generating unit according to the first embodiment.

Hereinafter, there will be explained operations of the profile generating unit 310 according to the first embodiment, while referring to FIG. 14. FIG. 14 is a flowchart illustrating the operations of the profile generating unit 310 according to the first embodiment.

The profile generating unit 310 according to the first embodiment obtains one of predetermined voltage conditions (step S1401) by the profile generating image output unit 311. In the first embodiment, plural patterns of voltage values that are to be used for generating profiles have been defined as the voltage conditions in advance, and the voltage conditions have been stored in the storing area such as the ROM 202 or the RAM 203.

When the profile generating image output unit 311 obtains the voltage values from the voltage condition, the profile generating image output unit 311 outputs profile generating images for the corresponding nozzle sequences in accordance with the obtained voltage values (step S1402). Here, the profile generating image output unit 311 outputs a first profile generating image in which the dots are formed only by the nozzle sequence 10 and a second profile generating image in which the dots are formed only by the nozzle sequence 20.

Subsequently, the image reading unit 312 reads the output profile generating images by using a sensor or the like (step S1403). The read value analyzing unit 313 analyzes the output values of the sensor (step S1404), which have been read by the image reading unit 312, and generates profiles of the corresponding nozzle sequences (step S1405).

Specifically, the read value analyzing unit 313 analyzes the output values of the sensor, and obtains values such as the density values of the profile generating images for the corresponding nozzle sequences, line widths, presence or absence of satellites, density values of the satellites, and a difference between the line widths for each of the nozzle sequences. Then, the read value analyzing unit 313 stores the values of the items for the corresponding nozzle sequences as the profiles of the corresponding nozzle sequences.

Subsequently, the profile generating image output unit 311 outputs profile generating images in which the dots formed by the nozzle sequence 10 are combined with the dots formed by the nozzle sequence 20, in accordance with the voltage condition obtained at step S1401 (step S1406). At this time, the profile generating image output unit 311 generates the plural patterns of profile generating images based on predetermined plural patterns of positional relation information. The image reading unit 312 reads the generated plural patterns of the profile generating images, and outputs output values of the sensor.

Subsequently, the read value analyzing unit 313 analyzes the plural output values of the sensors corresponding to the plural profile generating images. The read value analyzing unit 313 obtains the positional relation information corresponding to the case where the profile generating image having the highest image density value is output (step S1407).

Subsequently, the profile generating image output unit 311 determines whether the processes from step S1402 to step S1407 have been performed for all the defined voltage conditions (step S1408). When the profile generating image output unit 311 determines that the processes have not been performed for all the voltage conditions, the profile generating unit 310 returns to step S1401. On the other hand, when the profile generating image output unit 311 determines that the processes have been performed for all the voltage conditions, the profile generating unit 310 stores the profiles of the corresponding nozzle sequences for the voltage conditions and the profiles corresponding to the combinations of the voltage conditions and the positional relation information in the ROM 202 or in the RAM 203 (step S1409) as profile data.

When the profile generating unit 310 stores the profile data as described above, the table generating unit 320 generates a drive condition table, and stores the drive condition table in the ROM 202 or in the RAM 203 (step S1410). The details of the processing of the table generating unit 320 will be described later.

Namely, the profile data in the first embodiment includes the profiles of the corresponding nozzle sequences that have been output for each of the voltage conditions. Here, the profiles of the corresponding nozzle sequences have been obtained from the profile generating image data for the corresponding nozzle sequences. Further, the profile data according to the first embodiment includes the profiles of the combination of the plural nozzle sequences which have been obtained from the profile generating images formed by the plural nozzle sequences for each combination of the voltage condition and the positional relation information (hereinafter, referred to as the combined profiles).

Next, the table generating unit 320 according to the first embodiment will be explained.

The table generating unit 320 according to the first embodiment scores the profile data, and generates the drive condition table in which items of the profile data are associated with the corresponding driving conditions.

Here, each of the driving conditions according to the first embodiment is the corresponding combination of the voltage condition and the positional relation information. The voltage condition is the voltage values of the driving signals. The positional relation information is information indicating the timings to supply the driving signals to the corresponding nozzle sequences.

The table generating unit 320 refers to the profile data by the profile reference unit 321. The table generating unit 320 refers to the score table by the score table reference unit 322. Then, the table generating unit 320 scores the profile data. The score table that will be explained below may be stored in advance in the ROM 202 or in the RAM 203, for example.

Hereinafter, the score table will be explained, while referring to FIGS. 15-18. FIG. 15 is a first diagram illustrating the score table. The score table 151 shown in FIG. 15 is utilized for scoring the line widths of the corresponding nozzle sequences included in the profiles of the corresponding nozzle sequences. In the score table 151, for example, the range from the upper limit of the line width to the target value of the line width is divided into ten subranges, and the ten subranges correspond to the scores of 1 through 10, respectively. The upper limit of the line width has been defined, for example, by the standard of the image forming apparatus 100. Here, when the line width is greater than or equal to the upper limit, the line width corresponds to the score of 0. Similarly, in the score table 151, the range from the target value of the line width to the lower limit of the line width is divided into ten subranges, and the ten subranges correspond to the scores of 1 through 10, respectively. Here, when the line width is less than or equal to the lower limit, the line width corresponds to the score of 0. In the score table 151, the scores are defined so that the score becomes greater as the line width becomes closer to the target value.

FIG. 16 is a second diagram illustrating the score table. A score table 161 shown in FIG. 16 is utilized so as to score the difference between the line width of one of the corresponding nozzle sequences and the line width of the other nozzle sequence. Here, the line widths of the nozzle sequences are included in the profiles of the corresponding nozzle sequences. In the score table 161, the range from the upper limit of the difference between the line widths to the target value of the difference between the line widths is divided into ten subranges, and the ten subranges correspond to the scores of 1 through 10, respectively. The upper limit of the difference between the line widths is defined, for example, by the standard of the image forming apparatus 100. Here, when the difference between the line widths is greater than or equal to the upper limit, the difference between the line widths corresponds to the score of 0. In the score table 161, the scores are defined so that the score becomes greater as the difference between the line widths becomes closer to the target value.

FIG. 17 is a third diagram illustrating the score table. A score table 171 shown in FIG. 17 is utilized so as to score the satellites of the corresponding nozzle sequences. The satellites of the nozzle sequences are included in the profiles of the corresponding nozzle sequences. The score table 171 scores, for each of the nozzle sequences, the ratio of the amount of the ink covering the satellite with respect to the amount of the ink covering one dot.

In the score table 171, the range from the upper limit of the ratio of the amount of the ink covering the satellite to the target value is divided into ten subranges, and the ten subranges correspond to the scores of 1 through 10, respectively. The upper limit of the ratio of the amount of the ink covering the satellite is defined by the standard of the image forming apparatus 100, for example. Here, when the ratio of the amount of the ink covering the satellite is greater than or equal to the upper limit, the ratio of the amount of the ink covering the satellite corresponds to the score of 0. In the score table 171, the scores are defined so that the score becomes greater as the ratio of the amount of the ink covering the satellite becomes closer to the target value.

FIG. 18 is a fourth diagram illustrating the score table. The score table 181 shown in FIG. 18 is utilized so as to score the density of the images included in the profiles of the corresponding nozzle sequences and the combined profiles. In the score table 181, the range from the lower limit of the image density value to a predetermined value of the image density is divided into ten subranges, and the ten subranges correspond to the scores of 1 through 10, respectively. The lower limit of the image density value is defined by the standard of the image forming apparatus 100, for example. Here, when the image density value is less than or equal to the lower limit of the image density value, the image density value corresponds to the score of 0. In the score table 181, the scores are defined so that the score becomes greater as the image density value becomes closer to the predetermined value. When the image density value is greater than or equal to the predetermined value, the image density value corresponds to the score of 10. The predetermined value of the image density is defined, for example, by the specification of the image forming apparatus 100.

In the table generating unit 320 according to the first embodiment, the drive condition table generating unit 323 scores the items included in the profiles of the corresponding nozzle sequences and the density values included in the combined profiles (hereinafter, referred to as the solid image density values) by referring to the score tables 151, 161, 171, and 181. Then, the drive condition table generating unit 323 associates the drive conditions with the scores.

FIG. 19 is a first diagram showing an example of the drive condition table. In the drive condition table 191 shown in FIG. 19, the sequence of the dots formed by the nozzle sequence 10 is referred to as a line 11, and the sequence of the dots formed by the nozzle sequence 20 is referred to as a line 12. Further, the drive condition table 191 scores, for each of the driving conditions, the line width and the satellite of the line 11, line width and the satellite of the line 12, and the solid image density value. The drive condition table 191 may include total scores 192 where the scores of the corresponding items are summed up for each of the drive conditions.

The driving signal correction unit 330 refers to the drive condition table 191, and the driving signal correction unit 330 selects the driving condition of the driving signals. In the first embodiment, a drive condition may be made unselectable, provided that a score of a specific item under the drive condition is less than or equal to a predetermined value.

FIG. 20 is a second diagram showing an example of the drive condition table. In the drive condition table 193 shown in FIG. 20, a drive condition in which a score of the satellite is less than or equal to 5 is unselectable. The drive condition table 193 may include total scores 194 where the scores of the corresponding items are summed up for each of the drive conditions.

The drive condition tables 191 and 193 according to the first embodiment score the line widths, the satellites, and the solid image density value. However, items to be scored are not limited to these. For example, the items to be scored may include the density values of the corresponding lines, and the difference between the line widths. Further, for example, the line widths and the satellites may not be scored. Further, in the drive condition tables 191 and 193 according to the first embodiment, a total score of the scores of the plural items, such as the line widths and the difference between the line widths, may be defined as the characteristic of the lines.

Next, there will be explained the processing of the driving signal correction unit 330 according to the first embodiment. The driving signal correction unit 330 according to the first embodiment refers to the drive condition table 191 by the selection condition acquisition unit 331, and determines the driving condition of the driving signals by the driving condition determination unit 332. When the drive condition has been determined by the driving signal correction unit 330, the driving signals are output to the recording head 170 in accordance with the determined drive condition.

The selection condition acquisition unit 331 acquires a selection condition that is utilized as a reference condition for selecting the drive condition from the image forming apparatus 100. The selection condition may be determined based on the setting of the image output mode in the image forming apparatus 100, for example. The selection condition may be automatically set in the image forming apparatus 100 upon the completion of the setting of the output mode.

For example, when the output mode has been set to the mode to output line drawing, a drive condition is preferable in which the scores of the satellites are small. Further, when the output mode is a photograph mode, a drive condition is preferable in which the score of the solid image density value is large. Namely, the selection condition according to the first embodiment is a condition for selecting the drive condition depending on the output mode.

Specifically, for example, when the selection condition is for selecting the maximum solid image density value, the driving condition determination unit 332 selects a drive condition which includes the maximum solid image density value from the drive condition table 191.

In the drive condition table 191, when the drive condition of the nozzle sequence 10 is γ and the drive condition of the nozzle sequence 20 is γ, the solid image density value becomes the largest value. Therefore, the driving condition determination unit 332 determines the drive condition of the nozzle sequence 10 to be γ and the drive condition of the nozzle sequence 20 to be γ. The drive condition γ includes voltage values of the driving signals to be supplied to the corresponding nozzle sequence and the timings to supply the driving signals.

Further, for example, when the selection condition is for selecting the maximum total score, the driving condition determination unit 332 selects the driving condition which includes the maximum total score from the drive condition table 191. In the drive condition table 191, when the drive condition of the nozzle sequence 10 is β and the drive condition of the nozzle sequence 20 is γ, the total score is maximized. Therefore, the driving condition determination unit 332 determines that the drive condition of the nozzle sequence 10 to be β and the drive condition of the nozzle sequence 20 to be γ.

After the determination of the drive condition, the driving signal correction unit 330 can correct the driving signals supplied to the recording head 170 based on the relationship between the discharging characteristics of the corresponding nozzle sequences by outputting the driving signals based on the drive condition.

The driving signal correction unit 330 may perform the similar correction of the driving signals by referring to the drive condition table 193.

Further, in the first embodiment, the driving signal correction unit 330 may perform the correction of the driving signals upon receiving an instruction from a user of the image forming apparatus 100, upon starting up the image forming apparatus 100, or at every predetermined time intervals.

Further, the process of generating the drive condition table 191 by the profile generating unit 310 and the table generating unit 320 and the process of correcting the driving signals by the driving signal correction unit 330 may not be continuous. For example, the drive condition table 191 may be generated in advance at the time at which the image forming apparatus 100 is activated and stored in the storing area. Subsequently, when the driving signal correction unit 330 performs the correction of the driving signals, the driving signal correction unit 330 may read out the drive condition table 191.

For the sake of simplicity, in the drive condition table 191 according to the first embodiment, the range of the score has been set to be from 0 to 10. However, the scoring method is not limited to this. For example, the image forming apparatus 100 may include a table for converting, for each item included in the profile data, a difference between a measured value and a target value into a score. The image forming apparatus 100 may perform the scoring by using this table.

As a method of converting the difference between the measured value and the target value, the following method may be considered. Namely, in the method, the variation of measured values from the target value is evaluated in advance, and a table is prepared such that it scores the measured value so that the scores are correlated with the normal distribution of the variation of the measured values. In such a case, since the characteristics include the smaller-the-better (S-type) characteristics, the greater-the-better characteristics, and the nominal-the-best (N-type) characteristics, it is preferable that a method of defining an axis be established for each type. For example, it is preferable that scoring axes be aligned in such a way that, for the width of the line, the score becomes higher as the width of the line becomes closer to the target value, and for the satellite, the score becomes higher as the satellite becomes fewer.

In the image forming apparatus 100 according to the first embodiment, it is preferable to perform the correction of the driving signals of the corresponding nozzle sequences, prior to performing the correction of the input-output characteristics where a relationship between an input value and an output value is corrected, such as the cases of the γ-correction and the color matching of image data.

The correction of the input-output characteristics is a process of correcting colors (and/or density) by adjusting the number of the dots or the ratio of the dots. Therefore, it is possible that the solid image density value is not increased. Further, it is possible that the differences in the diameters of the dots are corrected by varying the number of the dots. In such a case, a failure may occur such that, even if the density is unchanged, the difference between patterns is noticeable. In the first embodiment, the image quality can be improved by performing the correction of the input-output characteristics after the driving signals of the corresponding nozzle sequences have been suitably corrected.

Figure 21:
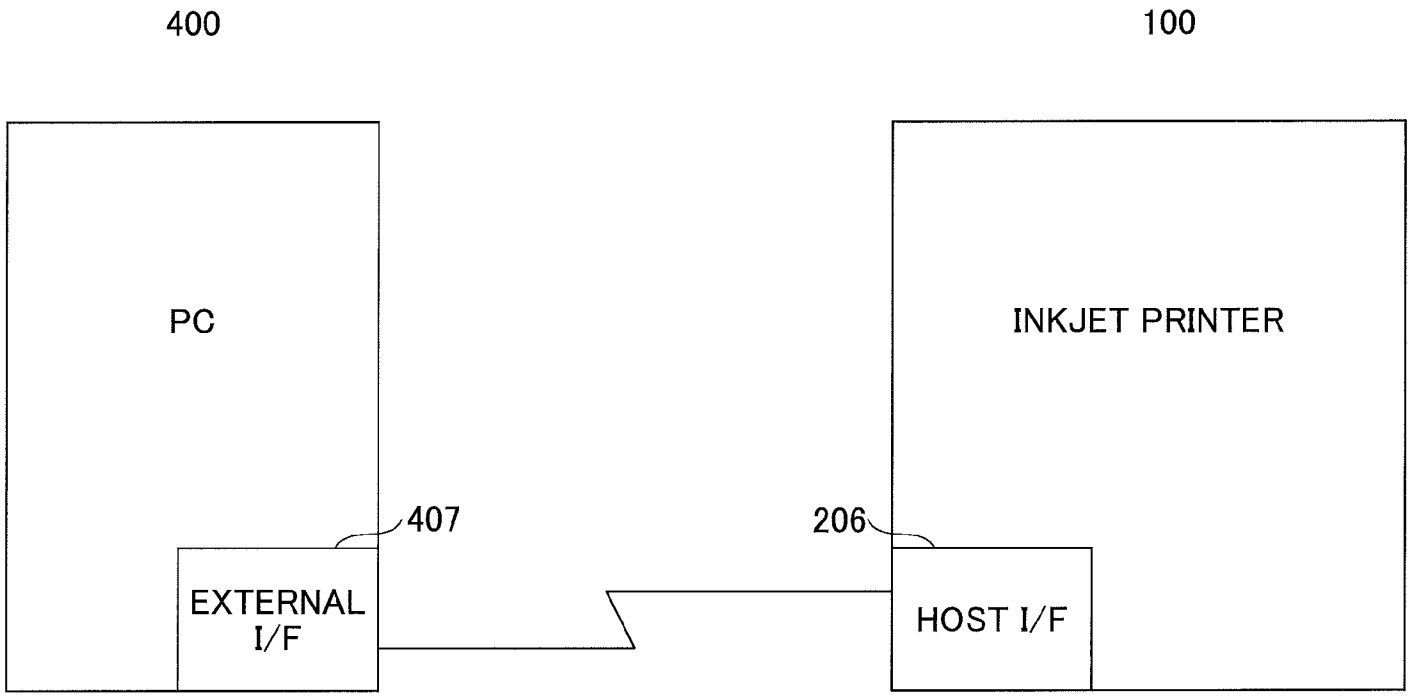
FIG. 21 is a diagram showing an example of a system configuration of an image forming system including the image forming apparatus and a personal computer (PC)

Further, the image forming apparatus 100 according to the first embodiment may be connected to a host (a personal computer (PC)), and thereby the image forming apparatus 100 may form an image forming system. FIG. 21 shows an example of a system configuration of the image forming system including the image forming apparatus 100 and the PC.

In the example of FIG. 21, the image forming apparatus 100 and the PC 400 are connected, and thereby forming the image forming system. In the image forming system, the host I/F 206 of the image forming apparatus 100 communicates with an external I/F 407 included in the PC 400.

In the first embodiment, for example, the tables may be stored in a storing device included in the PC 400. Specifically, for example, the score tables 151, 161, 171, and 181 may be included in the storing device of the PC 400. Additionally, the drive condition tables 191 and 193 may be stored in the storing device of the PC 400.

Further, in the image forming system shown in FIG. 21, the PC 400 may perform a part of the processes to be performed by the head control unit 200 of the image forming apparatus 100. Specifically, for example, a part of the processes of the read value analyzing unit 313, a part of the processes of the table generating unit 320, and/or a part of the processes of the driving signal correction unit 330 may be performed by the PC 400.

<Second Embodiment>

Hereinafter, a second embodiment of the present invention will be explained by referring to figures. The image forming apparatus 100 according to the second embodiment is different from that of the first embodiment only by a point that the image forming apparatus 100 according to the second embodiment includes plural recording heads, where each of the recording heads includes plural nozzle sequences. Therefore, in the explanation of the second embodiment below, only the point that is different from the first embodiment will be explained. For the components having the same functional configurations of the corresponding components in the first embodiment, the same reference numerals are attached, and the explanations of the components are omitted.

Figure 22:
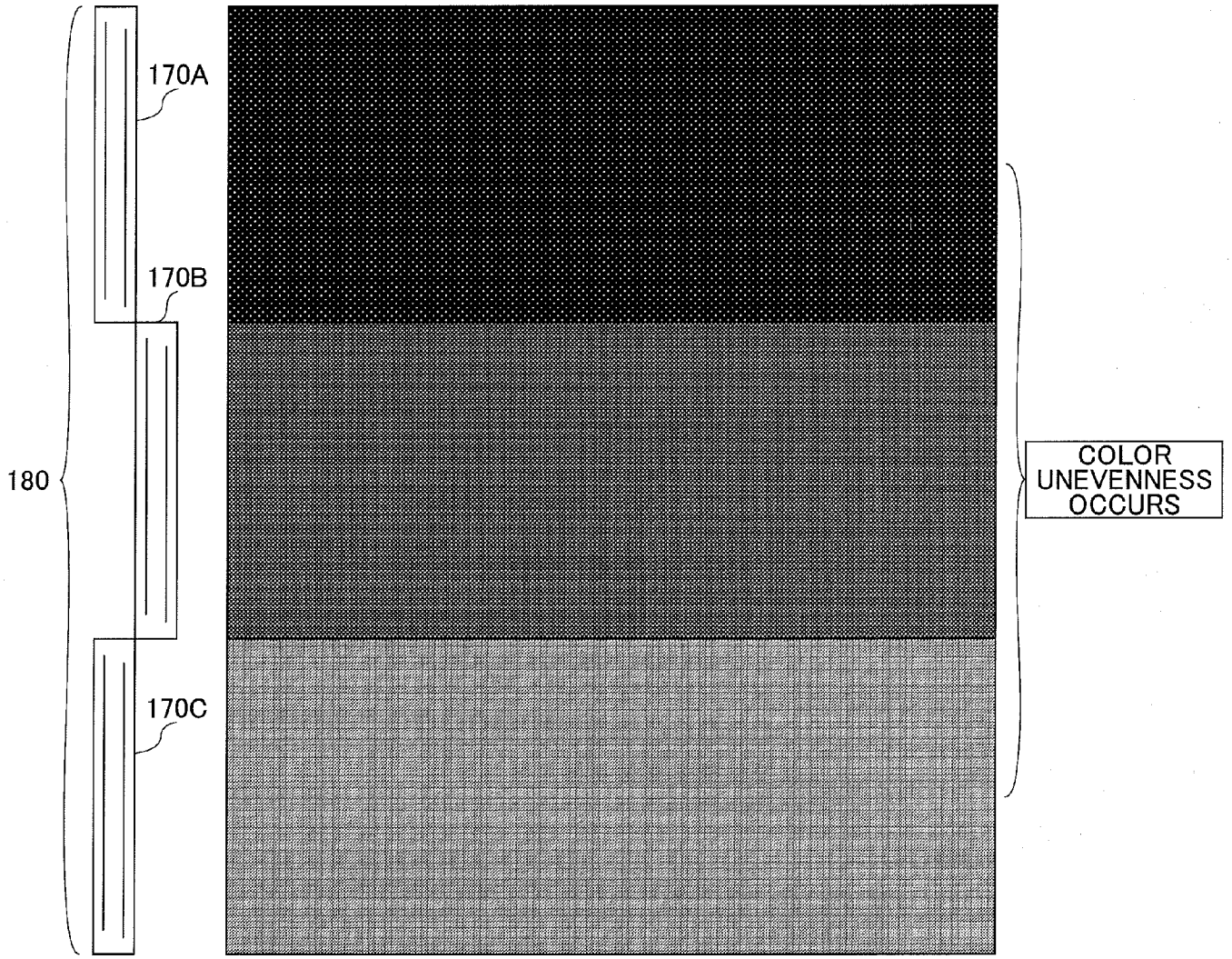
FIG. 22 is a diagram illustrating a recording head according to a second embodiment.

FIG. 22 is a diagram illustrating the recording head according to the second embodiment. The image forming apparatus 100 according to the second embodiment includes a recording head unit 180. The recording head unit 180 is formed by connecting three recording heads 170A, 170B, and 170C in the longitudinal direction of the recording heads 170A, 170B, and 170C.

Since the width of the image formed by the recording head unit 180 at once is large, the recording head unit 180 according to the second embodiment enables high-speed recording. However, in the recording head unit 180 according to the second embodiment, the recording heads 170A, 170B, and 170C have the corresponding individual characteristics. As shown in FIG. 22, in the image formed by the recording head unit 180, belt-shaped color unevennesses may be observed in the longitudinal direction of the recording head unit 180.

Therefore, in the recording head unit 180 according to the second embodiment, the correction of the driving signals is performed for each recording head.

Figure 23:
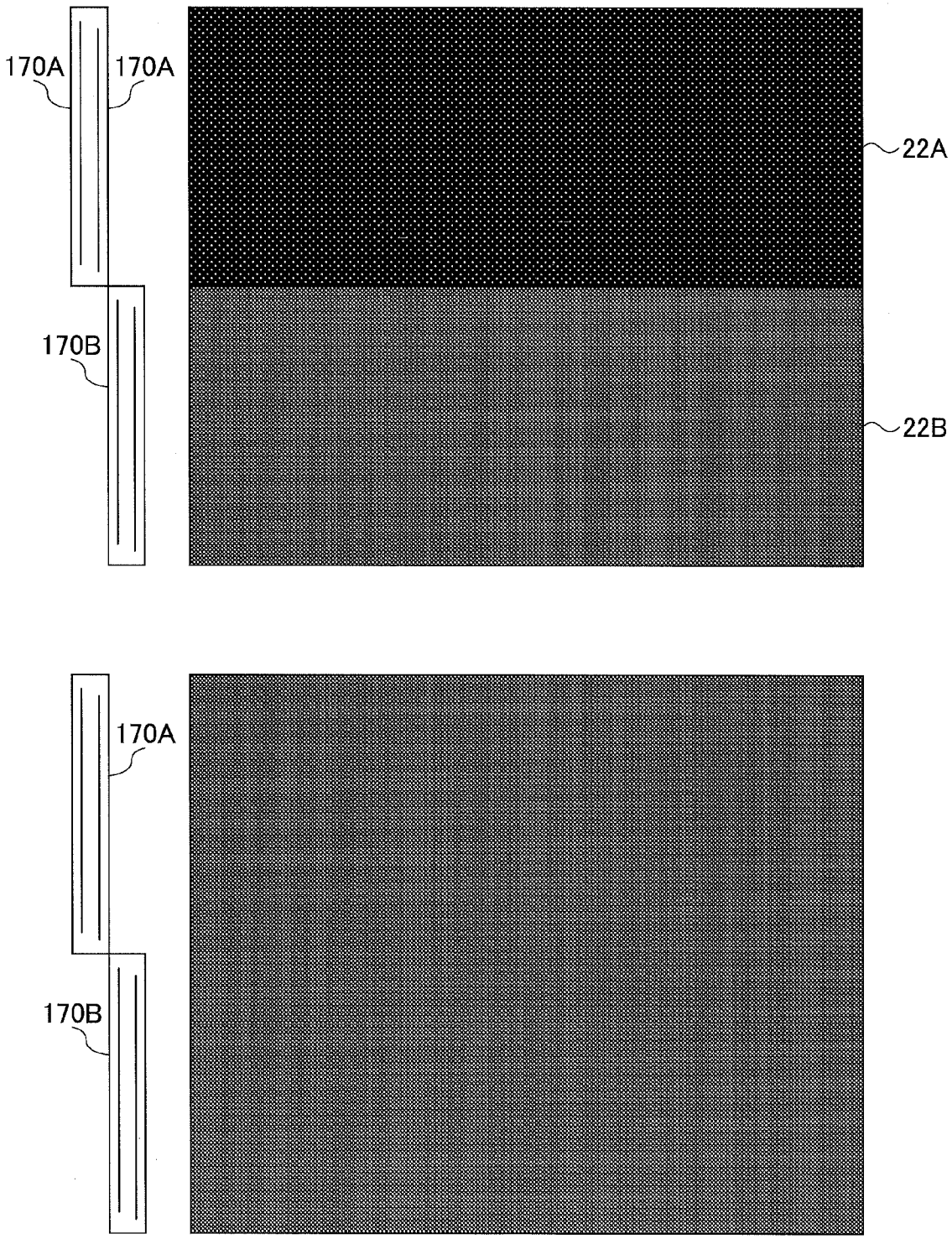
FIG. 23 is a diagram illustrating a correction process of drive signals for the corresponding recording heads included a recording head unit.

Hereinafter, the correction of the driving signals will be explained for each of the recording heads. FIG. 23 is a diagram illustrating the correction of the driving signals of each of the recording heads included in the recording head unit 180. Incidentally, in FIG. 23, for the sake of simplicity, only the recording heads 170A and 170B are explained among the three recording heads included in the recording head unit 180.

In the recording head unit 180, when a difference occurs between the density of the image 22A formed by the recording head 170A and the density of the image 22B formed by the recording head 170B, correction may be required so as to reduce the density difference between the image 22A and the image 22B.

Specifically, for example, for the recording head 170A, the drive condition has been determined so as to maximize the solid image density value. Similarly, for the recording head 170B, the drive condition has been determined so as to maximize the solid image density value. However, there has been observed the density difference between the density of the image 22A and the density of the image 22B. In such a case, the drive condition of the recording head that has formed the image having the higher density may be adjusted so that it is matched up with the drive condition of the recording head that has formed the image having the lower density.

In the second embodiment, when the correction of the driving signals is performed for each of the recording heads included in the recording head unit 180, the difference among the characteristics of the corresponding recording heads is considered.

Figure 24:
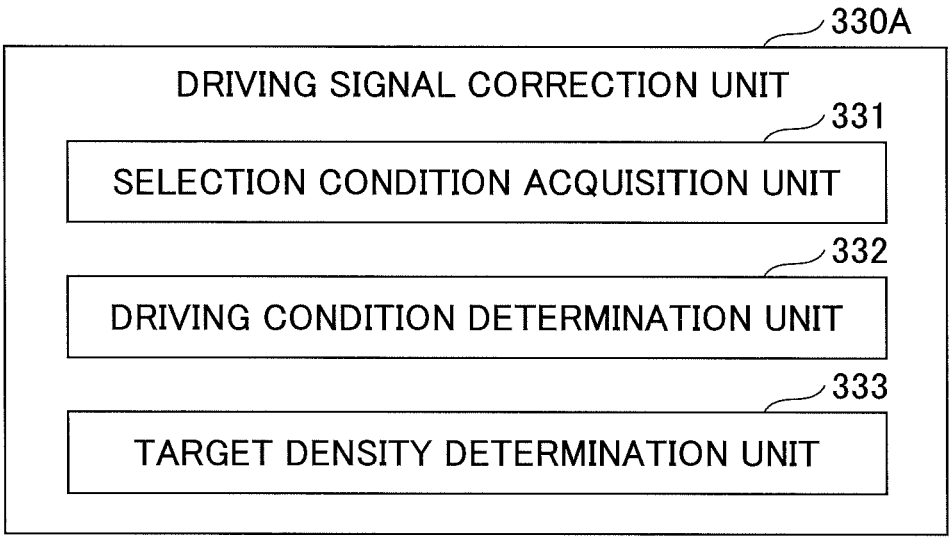
FIG. 24 is a diagram showing an example of a functional configuration of a drive signal correction unit according to the second embodiment.

FIG. 24 is a diagram showing an example of a functional configuration of the driving signal correction unit according to the second embodiment.

The driving signal correction unit 330A according to the second embodiment includes a target density determination unit 333. After the target density determination unit 333 has generated drive condition tables for the corresponding recording heads, the driving signal correction unit 330A according to the second embodiment determines a target density range that is common among the plural recording heads by referring to the drive condition tables for the corresponding recording heads.

Figure 25:
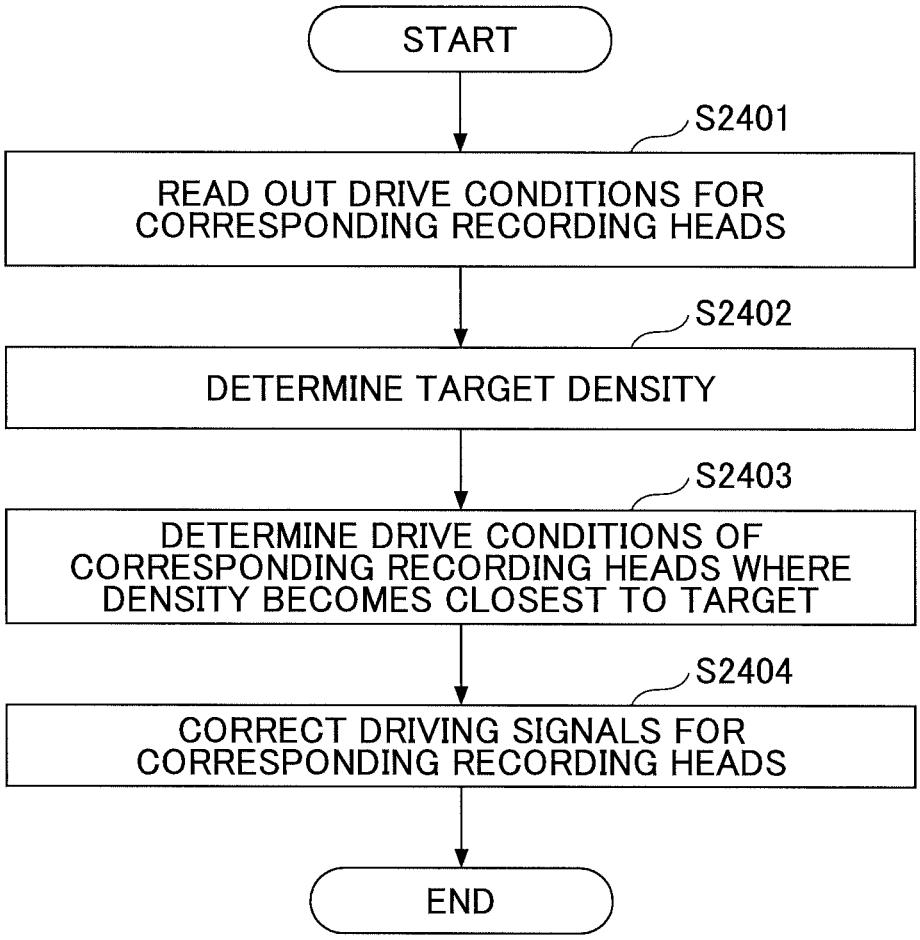
FIG. 25 is a flowchart illustrating operations of the drive signal correction unit according to the second embodiment.

FIG. 25 is a flowchart illustrating the operations of the driving signal correction unit 330A according to the second embodiment. The driving signal correction unit 330A according to the second embodiment reads out the drive condition tables for the corresponding recording heads 170A, 170B, and 170C in the recording head unit 180 (step S2401).

Subsequently, the target density determination unit 333 determines the target density that is common among the three recording heads 170A, 170B, and 170C (step S2402). After that, the driving condition determination unit 332 selects, for each of the recording heads 170A, 170B, and 170C, the drive condition, with which the density of the image is regulated within the target density range, from the drive condition table for the corresponding recording head (step S2403). Then, the driving signal correction unit 330A corrects, for each of the recording heads 170A, 170B, and 170C, the driving signals to be supplied to the corresponding recording head according to the selected drive condition (step S2404).

Hereinafter, there will be explained a method of determining the target density range according to the second embodiment. The target density determination unit 333 according to the second embodiment may set the target density range that is common among the recording heads 170A, 170B, and 170C to be a density range that has been defined for the whole image forming apparatus 100. In this case, it is preferable that the target density range be the range of the density that can be output by all the recording heads 170A, 170B, and 170C included in the recording head unit 180.

Further, according to the second embodiment, the target density may be set to be a value with which one of an average value, a median, and a deviation of the density values of the corresponding recording heads 170A, 170B, and 170C is minimized. With such a target range, some recording heads may not demonstrate maximum performance. However, with such a target range, it is possible to prevent these recording heads from forming an image having the density that is far from the target density.

Further, the density having the lowest score among the density values of the images formed by the recording heads 170A, 170B, and 170C may be set to be the target density that is common among the recording heads 170A, 170B, and 170C. By setting the density having the lowest score to be the target density, the difference among the density values of the recording heads 170A, 170B, and 170C may further be reduced.

Hereinafter, there will be explained the determination of the target density range according to the second embodiment, while referring to FIGS. 26-30. FIGS. 26-30 show the case where the recording head unit includes five recording heads A, B, C, D, and E.

Figure 26:
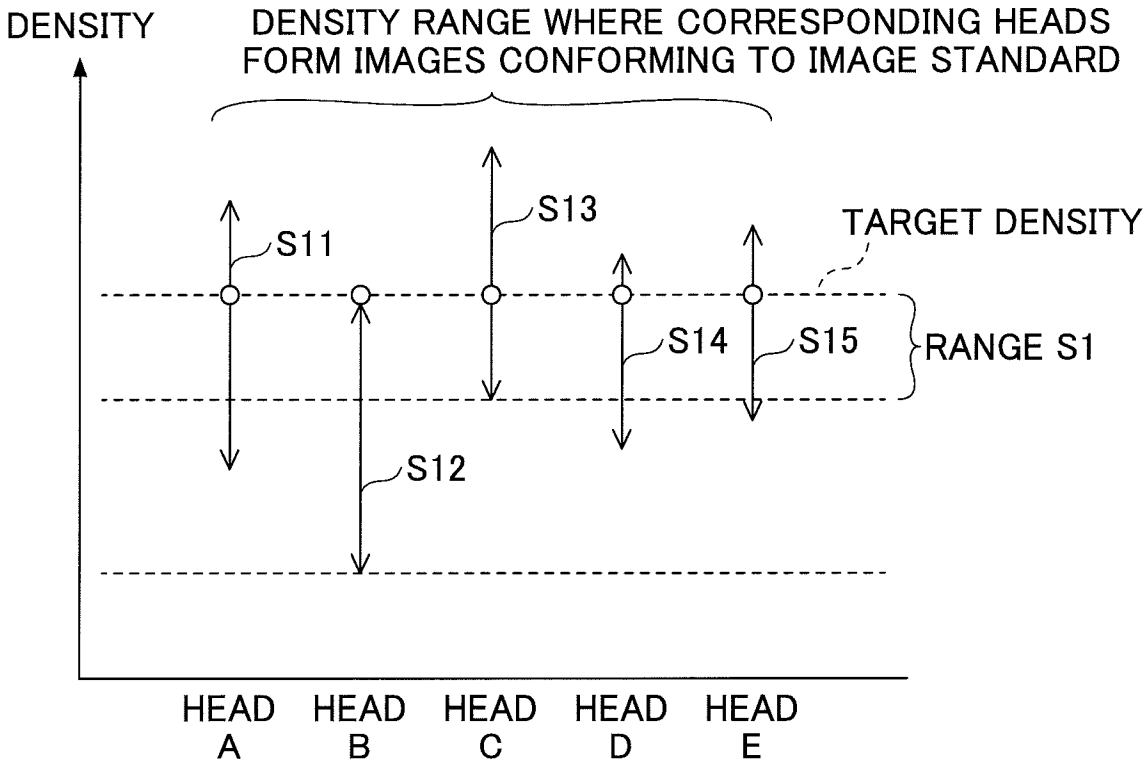
FIG. 26 is a first diagram illustrating a determination process of determining target density ranges.

FIG. 26 is a first diagram illustrating the determination of the target density range. The recording head A can output an image having density within a density range S11, provided that the recording head A is driven in a range of the drive condition within which an image formed by the recording head A conforms to the image standard. Similarly, the recording heads B, C, D, and E can output images having density values within corresponding density ranges S12, S13, S14, and S15, provided that the recording heads B, C, D, and E are driven in ranges of the drive conditions within which images formed by the corresponding recording heads B, C, D, and E conform to the image standard. FIG. 26 shows a case where there exists a range S1 within the ranges S11, S12, S13, S14, and S15 in which the difference among the density values of the corresponding recording heads A, B, C, D, and E can be set to be 0. In the example of FIG. 26, the target density is set to be the highest density value within the range S1 where the difference among the density values can be set to be 0. The driving signals supplied to the corresponding recording heads A, B, C, D, and E are corrected by the corresponding drive conditions, with which the corresponding recording heads A, B, C, D, and E can output images having the density values closer to the target density.

Figure 27:
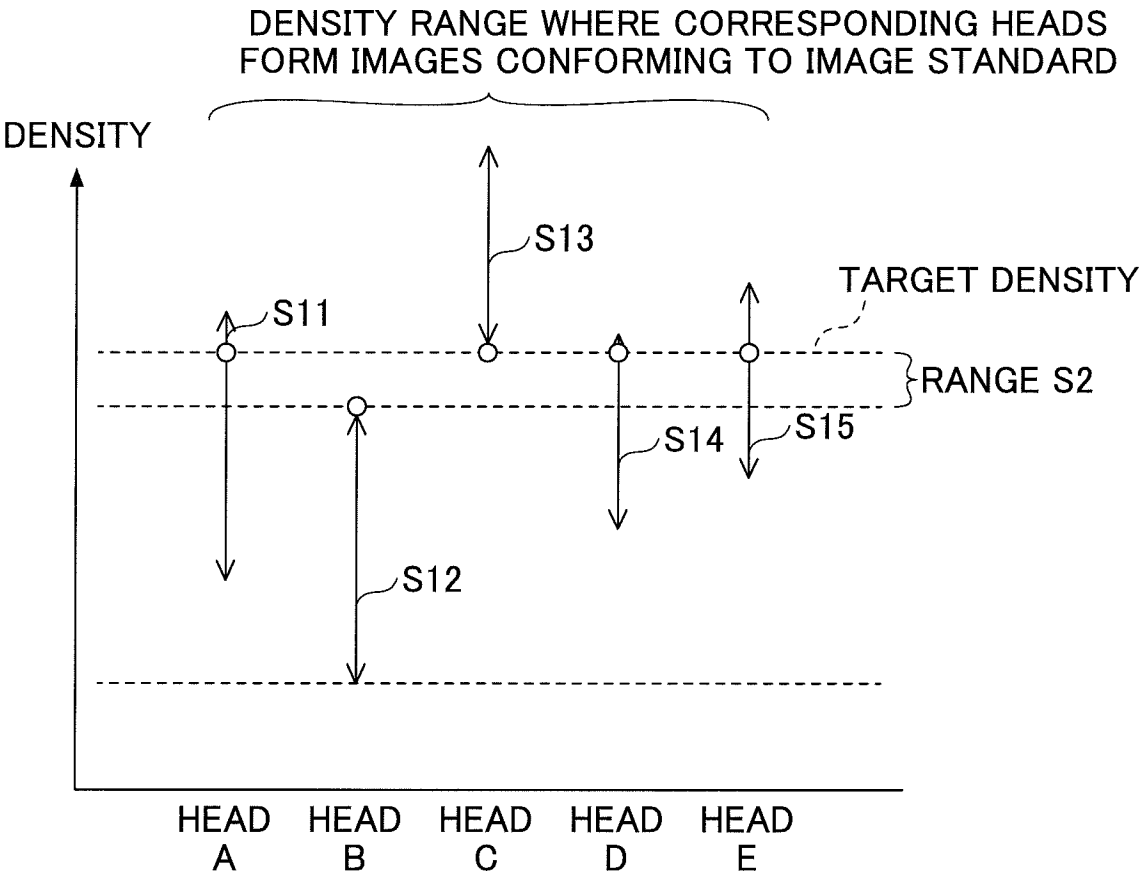
FIG. 27 is a second diagram illustrating the determination process of determining the target density ranges.

FIG. 27 is a second diagram illustrating the determination of the target density range. FIG. 27 shows a case where there are no density ranges within the density ranges S11, S12, S13, S14, and S15, in which the difference among the density values can be set to be 0. In FIG. 27, it is not possible to set the difference between the density value of the recording head B and the density value of the recording head C to be 0. That is because there is a gap (the range S2) between the density range S12 of the recording head B and the density range S13 of the recording head C. Therefore, in the example of FIG. 27, it is impossible to set the difference among the density values of the recording heads A, B, C, D, and E to be 0.

In this case, the range between the upper limit of the density that can be output by the recording head B and the lower limit of the density that can be output by the recording head C (the range S12) is the range where the difference among the recording heads A, B, C, D, and E is minimized. Here, the target density is set to be the lower limit of the recording head C, so that the entire density levels can be increased. The white circles in FIG. 27 indicate the target density values of the corresponding recording heads A, B, C, D, and E. In the example of FIG. 27, only the density value of the recording head B is slightly different from the density values of the recording heads A, C, D, and E.

Figure 28:
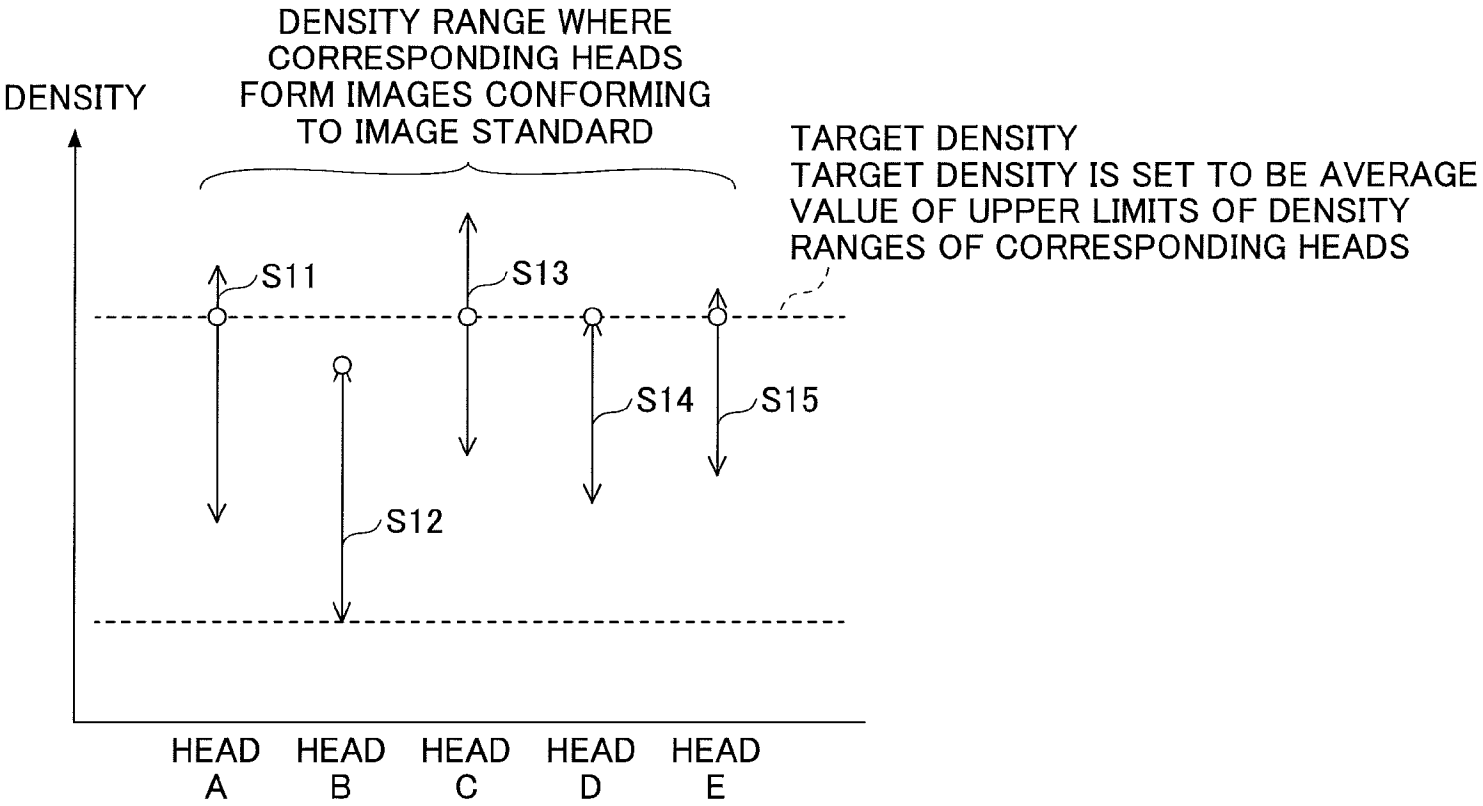
FIG. 28 is a third diagram illustrating the determination process of determining the target density ranges.

FIG. 28 is a third diagram illustrating the determination of the target density range. FIG. 28 shows a case where the target density is calculated from the density ranges S11, S12, S13, S14, and S15. Here, the target density is set to be the average value of the upper limits of the density values that can be output by the corresponding recording heads A, B, C, D, and E.

Figure 29:
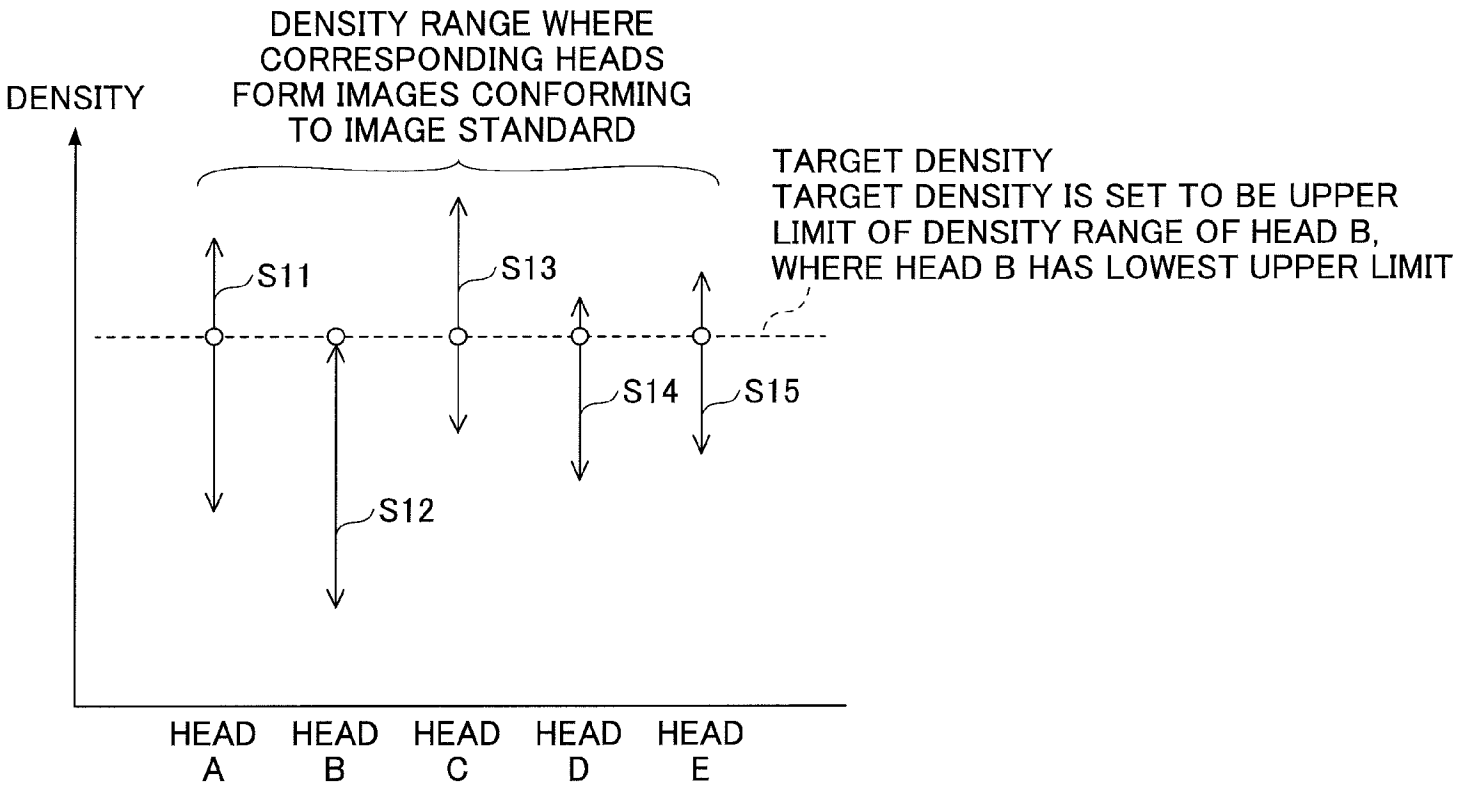
FIG. 29 is a fourth diagram illustrating the determination process of determining the target density ranges.

FIG. 29 is a fourth diagram illustrating the determination of the target density range. FIG. 29 shows a case where the lowest value of the upper limits of the density ranges S11, S12, S13, S14, and S15 is used as a reference to set the target density. In the example of FIG. 29, the recording head B has the lowest upper limit value of the density. Therefore, the target density is set to be the upper limit value of the density of the recording head B.

Figure 30:
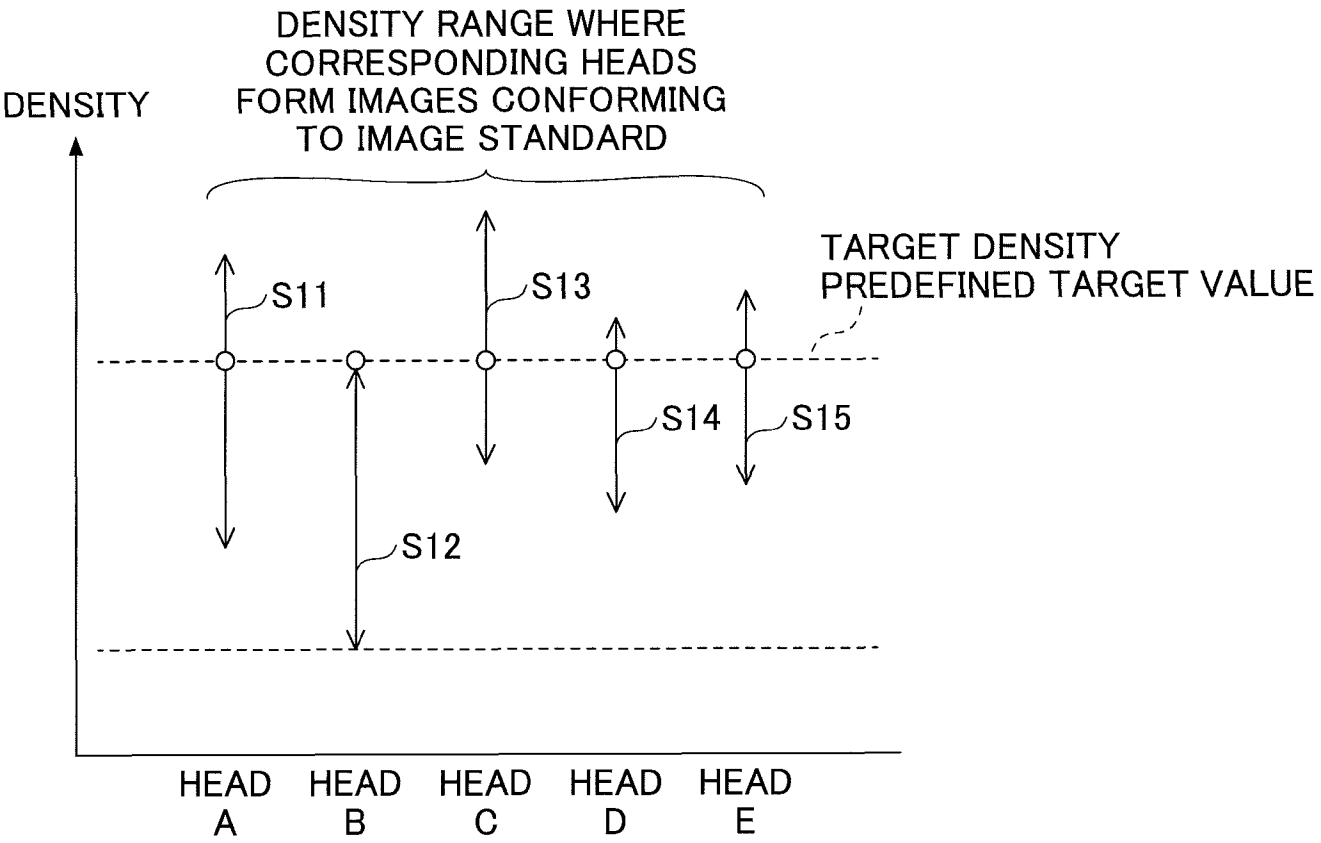
FIG. 30 is a fifth diagram illustrating the determination process of determining the target density ranges.

FIG. 30 is a fifth diagram illustrating the determination of the target density range. FIG. 30 shows a case where the target density is set to be a predetermined value, irrespective of the density ranges S11, S12, S13, S14, and S15. In this case, each of the recording heads A, B, C, D, and E sets the drive condition, with which the density value becomes closer to the target density, within a range in which the image formed by the recording head conforms to the image standard.

<Third Embodiment>

Hereinafter, a third embodiment of the present invention will be explained, while referring to figures. In the third embodiment of the present invention, the satellites of the corresponding nozzle sequences included in the profiles of the corresponding nozzle sequences are scored based on estimated values derived by a satellite prediction formula. In the explanation of the third embodiment below, only the points of difference from the first embodiment are explained. The reference numerals that have been used in the explanation of the first embodiment are attached to components having functional configurations that are the same as those of the first embodiment, and the explanations of the components are omitted.

Figure 31:
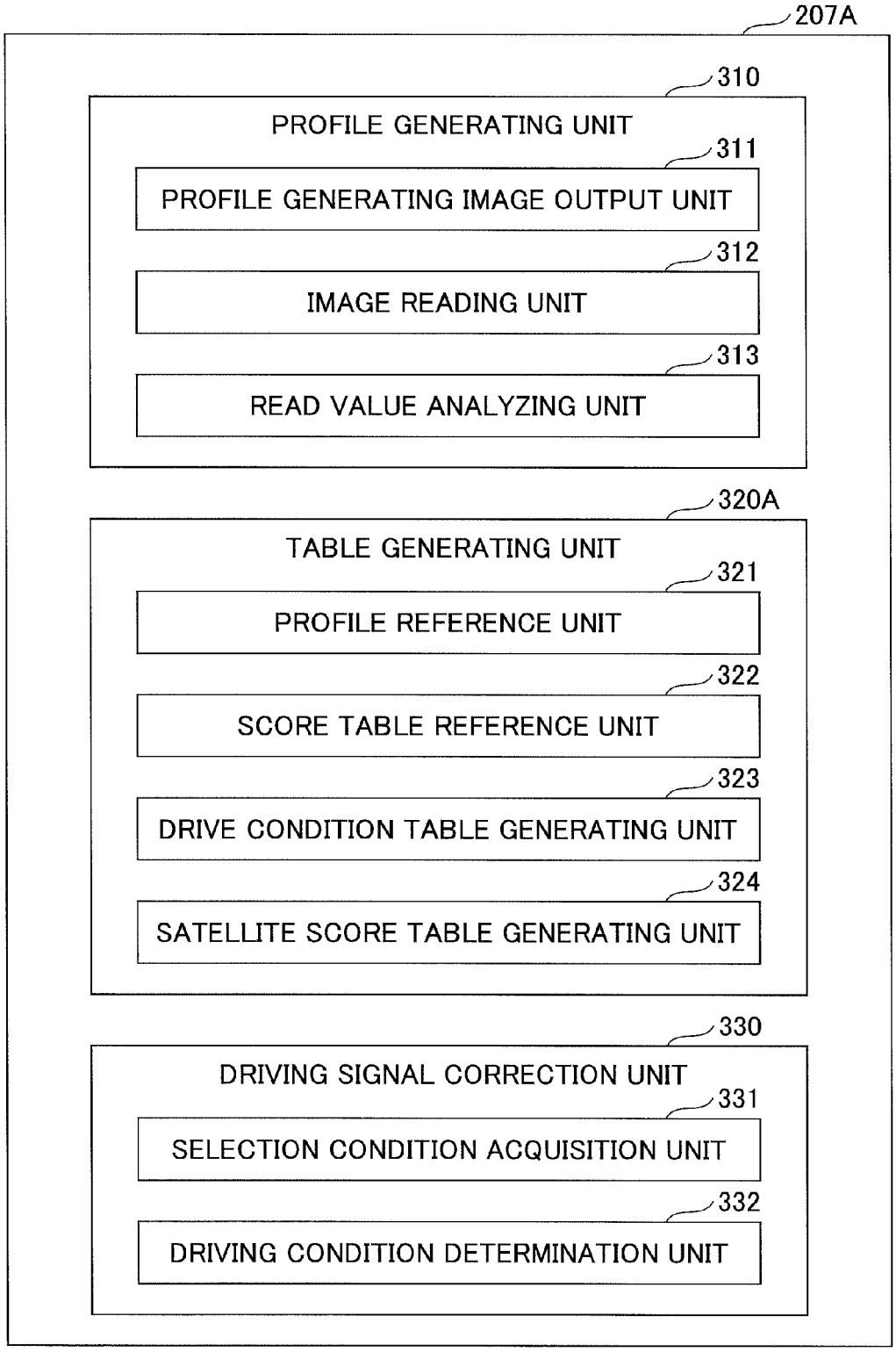
FIG. 31 is a diagram showing an example of a functional configuration of the head control unit according to a third embodiment.

FIG. 31 is a diagram showing an example of a functional configuration of the head control unit according to the third embodiment.

The table generating unit 320A of the head control unit 207A according to the third embodiment includes a satellite score table generating unit 324 in addition to the other units included in the table generating unit 320 according to the first embodiment.

The satellite score table generating unit 324 according to the third embodiment obtains predetermined variables as parameters from an analyzing result of the output values of the sensor that have been read by the read value analyzing unit 313. Then, the satellite score table generating unit 324 calculates the estimated values. After that, the satellite table score generating unit 324 scores the calculated estimated values according to predetermined levels, and generates the score table of the satellites by using the scores.

Hereinafter, there will be explained the satellite prediction formula according to the third embodiment. The satellite prediction formula according to the third embodiment is a predetermined formula. The satellite prediction formula is stored in advance in the ROM 202 or in the RAM 203, for example.

The satellite prediction formula according to the third embodiment is obtained, for example, by obtaining physical quantities that can be predetermined candidates for variables from the analyzing result of the output values and by using the obtained physical quantities as the variables. The satellite prediction formula according to the third embodiment is a multiple regression function obtained by using, for example, a number of occurrences of the satellites for each of the nozzle sequences, a size of the satellite, an adhering position of the satellite, and an adherence range of the satellite as the variables. For example, when the number of occurrences of the satellites is Ns, the size of the satellite is Ss, the adhering position of the satellite is Ps, and the adherence range of the satellite is Rs, the satellite prediction formula is expressed by $A \times Ss + B \times Ns + C \times Ps + D \times Rs$, where A, B, C, and D are coefficients. The coefficients A, B, C, and D are values that may be obtained, for example, by repeating the processes of forming plural profile generating images and analyzing the formed profile generating images.

In the third embodiment, the adhering position Ps of the satellite may be expressed by a distance between a centroid of a main droplet and a centroid of the satellite. Further, in the third embodiment, the adherence range Rs of the satellite may be an ink coating amount.

Further, in the satellite prediction formula according to the third embodiment, the number of occurrences of the satellites Ns may be values that are measured for the corresponding nozzle sequences. Further, in the satellite prediction formula according to the third embodiment, the size of the satellites Ss may be an average value or a median of the diameters of the satellites that have been occurred for the nozzle sequences.

Further, in the satellite prediction formula according to the third embodiment, the adhering position of the satellite Ps may be expressed, for each dot, by the distance between the centroid of the main droplet and the centroid of the satellite. Further, when plural satellites are generated for a single dot, the adhering position of the satellite Ps may be a total value of the distances between the centroid of the main droplet and the centroids of the satellites. Alternatively, the adhering position of the satellite Ps may be the greatest value among the distances between the centroid of the main droplet and the centroids of the satellites.

Further, in the satellite prediction formula according to the third embodiment, the adherence range Rs may be a total amount of the ink coating amounts of the satellites occurred for the nozzle sequences.

Next, there will be explained satellite estimated values to be calculated by the satellite prediction formula according to the third embodiment. The satellite estimated values calculated by the satellite prediction formula according to the third embodiment are values that have a correlation with an image evaluation result by a sensory test.

Figure 32:
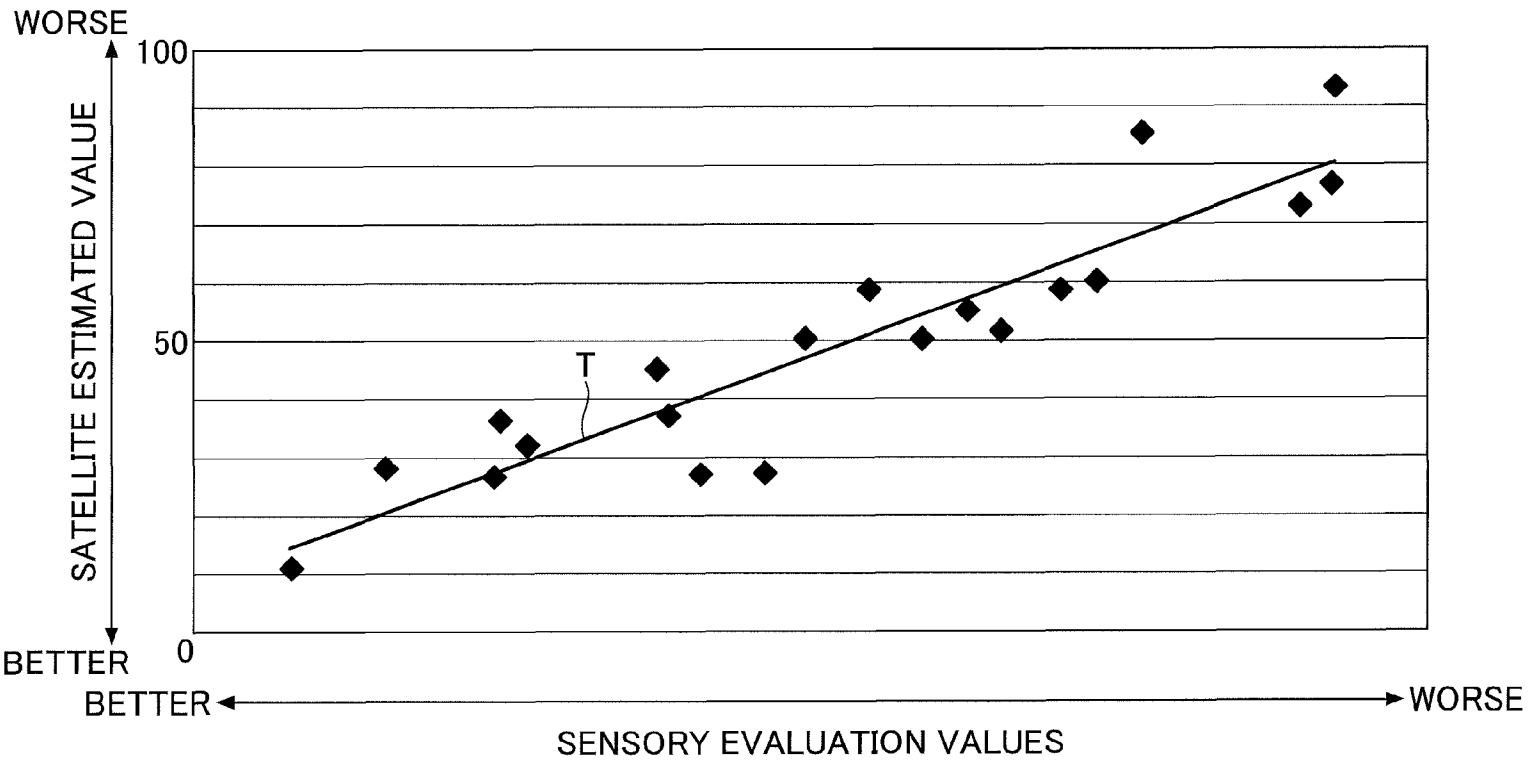
FIG. 32 is a diagram showing a relationship between satellite estimated values and an image evaluation result by a sensory test.

FIG. 32 is a diagram showing a relationship between the satellite estimated values and the image evaluation result by the sensory test. In FIG. 32, the horizontal axis indicates sensory evaluation values that represent the image evaluation result by the sensory test, and the vertical axis indicates the satellite estimated values.

In the third embodiment, the sensory test has been performed so as to make the ranking of fifteen samples, while setting the evaluation environment to be an office environment, the evaluators to be the workers who are engaged in the ink-jet printer business, and the evaluation method to be a ranking method that allows the same ranks. In the third embodiment, the results of the ranking by the corresponding evaluators are used as the sensory evaluation values.

In FIG. 32, the straight line T indicates the values derived by the satellite prediction formula, and the markers indicate the sensory evaluation values. FIG. 32 shows that the satellite prediction formula according to the third embodiment has a correlation with the sensory evaluation values more than a certain level. Namely, it can be understood that the estimated values derived by the satellite prediction formula according to the third embodiment reflect an unsatisfactory appearance of the actual image. Here, an image having a better appearance means that the image includes fewer satellites, the image is clearer, and the quality of the image is higher. On the other hand, an image having a worse appearance means that the image includes more satellites, and the image includes an unclear portion.

In the third embodiment, the satellite estimated values are calculated by using the predetermined variables obtained from the analyzing result of the profile generating images and the satellite prediction formula, and the satellites of the corresponding nozzle sequences are scored by using the calculated satellite estimated values.

Figure 33:
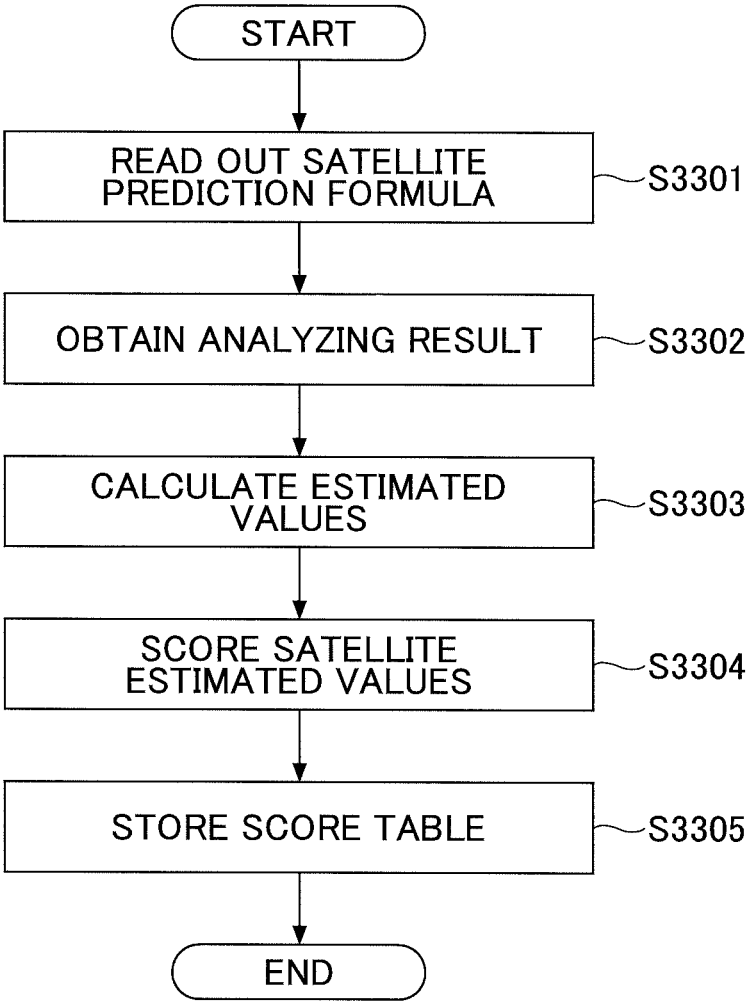
FIG. 33 is a flowchart illustrating a process performed by a score table generating unit according to a third embodiment.

FIG. 33 is a flowchart illustrating the processes of the score table generating unit 324 according to the third embodiment.

The satellite score table generating unit 324 according to the third embodiment reads out the satellite prediction formula stored, for example, in the ROM 202 or in the RAM 203 (step S3301). Then the score table generating unit 324 obtains the predetermined variables that can be obtained from the analyzing result of the read value analyzing unit 313 (step S3302). Subsequently, the satellite score table generating unit 324 calculates the satellite estimated values based on the satellite prediction formula and the predetermined variables (step S3303).

Subsequently, the satellite score table generating unit 324 scores the calculated satellite estimated values by dividing the values into predetermined levels, and thereby making the score table where the satellite estimated values are associated with the corresponding scores (step S3304). Then the satellite score table generating unit 324 stores the generated score table in the ROM 202 or in the RAM 203, for example (step S3305).

FIG. 34 is a fifth diagram illustrating the score table.

The score table 171A shown in FIG. 34 is utilized for scoring the satellites of the corresponding nozzle sequences included in the profiles of the corresponding nozzle sequences. In the score table 171A, the satellite estimated values for the corresponding nozzle sequences are scored.

In the score table 171A, the range of the satellite estimated value, which is the range from the upper limit value to the target value of the satellite estimated value, is divided into ten subranges. The divided ten subranges 91-100, 81-90, 71-80, 61-70, 51-60, 41-50, 31-40, 21-30, 11-20, and 1-10 are corresponding to the scores of 0, 1, 2, 3, 4, 5, 6, 7, 8, and 9, respectively. Here, when the satellite estimated value is equal to the target value, the satellite estimated value corresponds to the score of 10. In the score table 171A, the target value of the satellite estimated value is set to be 0. The score becomes greater as the satellite estimated value becomes closer to the target value.

As described above, in the third embodiment, by using the score table 171A, it is possible to select a drive condition that minimizes the deterioration effect of the satellites on the images. Here, in the score table 171A, the satellite estimated values have been scored. The satellite estimated values have been calculated by using the satellite prediction formula having the correlation with the sensory evaluation values.

As described above, in the third embodiment, even if the recording heads having the plural nozzle sequences are arranged, the driving conditions of the corresponding nozzle sequences can be adjusted so as to maintain fine composite image quality.

The third embodiment has been explained, while assuming that the target value that is common among the plural recording heads is the density. However, the similar processing can be applied to items other than the density.

In the above description, the image forming apparatus, the image correction method, and the image correction program have been explained based on the embodiments. However, the present invention is not limited to the above-described embodiments, and various modifications and improvements may be made within a scope of the present invention.

The present application is based on Japanese Priority Applications No. 2011-195776, filed on Sep. 8, 2011, and No. 2012-091693, filed on Apr. 13, 2012, the entire contents of which are hereby incorporated herein by reference.

What is claimed is:

1. An image forming apparatus that includes a recording head configured to form an image by discharging single color ink from plural nozzle sequences, the image forming apparatus comprising:

a profile generating unit configured to generate profiles based on individual images and combined images, the individual images each being images formed from one of the plural nozzle sequences and the combined images being images formed by all of the nozzle sequences, the profiles indicating discharge characteristics of each of the nozzle sequences and a positional relationship therebetween, the discharge characteristics including information on desired lines and undesired artifacts generated by the nozzle sequences;

a table generating unit configured to generate a drive condition table by scoring, for each combination of the drive conditions, the discharge characteristics associated with corresponding nozzle sequences; and a driving condition determination unit configured to determine the drive conditions of the corresponding nozzle sequences by selecting one of the drive conditions from the drive condition table based on selection criteria.

2. The image forming apparatus according to claim 1, wherein the profile generating unit is configured to cause the plural nozzle sequences to operate under predefined plural patterns of drive conditions, and the profile generating unit is configured to generate the profiles for the corresponding plural patterns of driving conditions.

3. The image forming apparatus according to claim 1, wherein the profile generating unit includes an image reading unit configured to read the individual images of a predetermined pattern; and a read value analyzing unit configured to analyze read values generated by reading the individual images of the predetermined pattern by the image reading unit, wherein the profile generating unit is configured to obtain the discharging characteristics of the corresponding nozzle sequences from an analyzing result by the read value analyzing unit.

4. The image forming apparatus according to claim 3, the information indicating the positional relationship among the plural nozzle sequences is obtained by density values of the combined images that have been formed by the nozzle sequences.

5. The image forming apparatus according to claim 4, wherein the profile generating unit is configured to obtain the density values of the combined images by combining the read values of the individual images.

6. The image forming apparatus according to claim 4, wherein the profile generating unit is configured to obtain the density values of the combined images by causing the image reading unit to read the combined images that have been formed by the nozzle sequences and by causing the read value analyzing unit to analyze a read result by the image reading unit.

7. The image forming apparatus according to claim 1, wherein the discharging characteristics of the corresponding nozzle sequences include at least one of density values of the desired lines formed by the nozzle sequences, widths of the desired lines, and a number or a size of the undesired artifacts.

8. The image forming apparatus of claim 1, wherein the driving condition determination unit is configured to determine the drive conditions of the corresponding nozzle sequences by selecting one of the drive conditions from the drive condition table based on selection criteria such that the drive condition is selected based on an amount of unwanted artifacts if an output mode of the image forming apparatus is a text mode, and the drive condition is selected based on a density of the desired lines if the output mode of the image forming apparatus is a photograph mode.

9. An image correction method executed by an image forming apparatus including a recording head configured to form an image by discharging single color ink from plural nozzle sequences, the method comprising:

a profile generating step, by the image forming apparatus, of generating a profiles based on individual images and combined images, the individual images each being images formed from one of the plural nozzle sequences and the combined images being images formed by all of the nozzle sequences, the profiles indicating discharge characteristics of each of the nozzle sequences and a positional relationship therebetween, the discharge characteristics including information on desired lines and undesired artifacts generated by the nozzle sequences;

a table generating step of generating, by the image forming apparatus, a drive condition table by scoring, for each combination of the drive conditions, the discharge characteristics associated with corresponding nozzle sequences; and a driving condition determination step, by the image forming apparatus, of determining the drive conditions of the corresponding nozzle sequences by selecting one of the drive conditions from the drive condition table based on selection criteria.

10. The image correction method of claim 9, wherein the driving condition determination step determines the drive conditions of the corresponding nozzle sequences by selecting one of the drive conditions from the storing unit based on selection criteria such that the drive condition is selected based on an amount of unwanted artifacts if an output mode of the image forming apparatus is a text mode, and the drive condition is selected based on a density of the desired lines if the output mode of the image forming apparatus is a photograph mode.

11. A non-transitory computer readable recording medium storing an image correction program for causing an image forming apparatus, the image forming apparatus including a recording head configured to form an image by discharging single color ink from plural nozzle sequences, to execute:

a profile generating step of generating a profile including discharging characteristics of corresponding nozzle sequences and information indicating a positional relationship among the plural nozzle sequences, based on individual images and combined images, the individual images each being images formed from one of the plural nozzle sequences and the combined images being images formed by all of the nozzle sequences, the profiles indicating discharge characteristics of each of the nozzle sequences and a positional relationship therebetween, the discharge characteristics including information on desired lines and undesired artifacts generated by the nozzle sequences;

a table generating step of generating a drive condition table by scoring, for each combination of the drive conditions, the discharge characteristics associated with the corresponding nozzle sequences; and a driving condition determination step of determining the drive conditions of the corresponding nozzle sequences from the drive condition table based on selection criteria.

12. The non-transitory computer readable recording medium of claim 11, wherein the driving condition determination step determines the drive conditions of the corresponding nozzle sequences by selecting one of the drive conditions from the storing unit based on selection criteria such that the drive condition is selected based on an amount of unwanted artifacts if an output mode of the image forming apparatus is a text mode, and the drive condition is selected based on a density of the desired lines if the output mode of the image forming apparatus is a photograph mode.

* * * * *